US009186901B2

(12) United States Patent
Nozawa et al.

(10) Patent No.: US 9,186,901 B2
(45) Date of Patent: Nov. 17, 2015

(54) METHOD FOR INJECTING PRINTING MATERIAL, INJECTION KIT, AND INJECTION DEVICE

(71) Applicant: Seiko Epson Corporation, Tokyo (JP)

(72) Inventors: Izumi Nozawa, Nagano (JP); Atsushi Kobayashi, Nagano (JP); Tadahiro Mizutani, Nagano (JP); Hidetoshi Kodama, Nagano (JP); Hiroyuki Nakamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/947,350

(22) Filed: Jul. 22, 2013

(65) Prior Publication Data

US 2014/0022314 A1 Jan. 23, 2014

(30) Foreign Application Priority Data

Jul. 23, 2012 (JP) ..... 2012-162233
Jul. 23, 2012 (JP) ..... 2012-162705
Aug. 31, 2012 (JP) ..... 2012-191386

(51) Int. Cl.
*B41J 2/175* (2006.01)

(52) U.S. Cl.
CPC ..... *B41J 2/17506* (2013.01); *B41J 2/175* (2013.01)

(58) Field of Classification Search
USPC ..... 347/84–87; 141/2, 18
See application file for complete search history.

(56) References Cited

U.S. PATENT DOCUMENTS

| | | | | |
|---|---|---|---|---|
| 5,825,388 | A | 10/1998 | Sasaki | |
| 5,980,032 | A | 11/1999 | Pawlowski, Jr. et al. | |
| 6,007,191 | A | 12/1999 | Fujii et al. | |
| 6,086,193 | A | 7/2000 | Shimada et al. | |
| 6,145,974 | A | 11/2000 | Shinada et al. | |
| 6,155,678 | A | 12/2000 | Komplin et al. | |
| 6,196,671 | B1 | 3/2001 | Breemes, Sr. et al. | |
| 6,203,148 | B1 | 3/2001 | Kishida | |
| 6,220,701 | B1 | 4/2001 | Umemura | |
| 6,250,750 | B1 | 6/2001 | Miyazawa et al. | |
| 6,254,226 | B1 | 7/2001 | Lengyel et al. | |
| 6,290,348 | B1 | 9/2001 | Becker et al. | |
| 6,332,481 | B1 | 12/2001 | Shinada et al. | |
| 6,585,007 | B2 | 7/2003 | Kubokawa | |
| 6,623,104 | B1 | 9/2003 | Kotaki et al. | |
| 6,776,479 | B2 | 8/2004 | Ardito et al. | |
| 6,824,258 | B2 | 11/2004 | Yamamoto et al. | |
| 6,848,776 | B2 | 2/2005 | Nishioka et al. | |
| 6,976,753 | B2 | 12/2005 | Kuwabara et al. | |
| 7,165,835 | B2 | 1/2007 | Ota et al. | |
| 7,237,881 | B2 | 7/2007 | Hayasaki et al. | |
| 7,293,866 | B2 | 11/2007 | Miyazawa et al. | |
| 7,325,909 | B2 * | 2/2008 | Yuen | 347/85 |
| 7,393,088 | B2 | 7/2008 | Sasaki | |
| 7,445,323 | B2 * | 11/2008 | Anderson et al. | 347/86 |
| 7,470,008 | B2 | 12/2008 | Yan | |

(Continued)

FOREIGN PATENT DOCUMENTS

| | | | |
|---|---|---|---|
| EP | 0655336 | A1 | 5/1995 |
| EP | 0712727 | A2 | 5/1996 |

(Continued)

*Primary Examiner* — Anh T. N. Vo
(74) *Attorney, Agent, or Firm* — Global IP Counselors, LLP

(57) ABSTRACT

An injection method includes closing an inner path, and injecting a printing material into a printing material containing chamber through a printing material supply port after closing the inner path.

8 Claims, 24 Drawing Sheets

(56) References Cited

U.S. PATENT DOCUMENTS

| | | | |
|---|---|---|---|
| 7,735,983 | B2 | 6/2010 | Pearson et al. |
| 7,918,547 | B2 | 4/2011 | Hatasa et al. |
| 7,938,523 | B2 | 5/2011 | Aldrich |
| 8,142,000 | B2 | 3/2012 | Ishizawa et al. |
| 8,177,342 | B2 | 5/2012 | Wanibe et al. |
| 8,366,250 | B2 | 2/2013 | Wanibe et al. |
| 8,366,251 | B2 | 2/2013 | Wanibe et al. |
| 8,382,263 | B2 | 2/2013 | Okajima |
| 8,684,505 | B2 | 4/2014 | Campbell-Brown et al. |
| 2002/0104578 | A1 | 8/2002 | Kubokawa |
| 2002/0139441 | A1 | 10/2002 | Schonfelder et al. |
| 2003/0090553 | A1 | 5/2003 | Jung et al. |
| 2004/0100540 | A1 | 5/2004 | Hatasa et al. |
| 2005/0041076 | A1 | 2/2005 | Katayama |
| 2005/0179750 | A1 | 8/2005 | Hayasaki et al. |
| 2005/0185034 | A1 | 8/2005 | Anma et al. |
| 2005/0219303 | A1 | 10/2005 | Matsumoto et al. |
| 2005/0275699 | A1 | 12/2005 | Sasaki |
| 2006/0132555 | A1 | 6/2006 | Uehara et al. |
| 2006/0203045 | A1 | 9/2006 | Kobayashi et al. |
| 2007/0024683 | A1 | 2/2007 | Yan |
| 2007/0139492 | A1 | 6/2007 | Anderson, Jr. et al. |
| 2007/0195141 | A1 | 8/2007 | Anma et al. |
| 2007/0195144 | A1 | 8/2007 | McNestry |
| 2008/0034712 | A1 | 2/2008 | Miyajima et al. |
| 2008/0204529 | A1 | 8/2008 | Matsumoto et al. |
| 2008/0230141 | A1 | 9/2008 | Hattori |
| 2008/0231672 | A1 | 9/2008 | Mano |
| 2008/0239037 | A1 | 10/2008 | Inoue et al. |
| 2008/0284833 | A1 | 11/2008 | Uehara et al. |
| 2009/0128609 | A1 | 5/2009 | Matsumoto et al. |
| 2009/0244221 | A1 | 10/2009 | Shimizu |
| 2009/0322832 | A1 | 12/2009 | Wanibe et al. |
| 2009/0322838 | A1 | 12/2009 | Wanibe et al. |
| 2009/0322839 | A1 | 12/2009 | Ishizawa et al. |
| 2010/0073438 | A1 | 3/2010 | Wanibe et al. |
| 2010/0208015 | A1 | 8/2010 | Matsumoto et al. |
| 2010/0302291 | A1 | 12/2010 | Matsumoto et al. |
| 2010/0309265 | A1 | 12/2010 | Matsumoto et al. |
| 2010/0309266 | A1 | 12/2010 | Matsumoto et al. |
| 2011/0037815 | A1 | 2/2011 | Anma et al. |
| 2011/0169899 | A1 | 7/2011 | Nozawa et al. |
| 2012/0127247 | A1 | 5/2012 | Anma et al. |
| 2012/0133713 | A1 | 5/2012 | Camp |
| 2013/0208044 | A1 | 8/2013 | Matsumoto et al. |

FOREIGN PATENT DOCUMENTS

| | | | |
|---|---|---|---|
| EP | 0739740 | A1 | 10/1996 |
| EP | 0847861 | A2 | 6/1998 |
| EP | 1053881 | A1 | 5/2000 |
| EP | 1095777 | A2 | 10/2000 |
| EP | 1053876 | A2 | 11/2000 |
| EP | 1080918 | A1 | 3/2001 |
| EP | 1170135 | A1 | 1/2002 |
| EP | 2103435 | A2 | 9/2009 |
| EP | 2380744 | A2 | 10/2011 |
| EP | 2425981 | A2 | 3/2012 |
| GB | 2288148 | A | 10/1995 |
| JP | 06-106729 | A | 4/1994 |
| JP | 08-112915 | A | 5/1996 |
| JP | 10-095129 | A | 4/1998 |
| JP | 10-250091 | A | 9/1998 |
| JP | 2000-203053 | A | 7/2000 |
| JP | 2001-063085 | A | 3/2001 |
| JP | 2001-130022 | A | 5/2001 |
| JP | 2002-036590 | A | 2/2002 |
| JP | 2002-120376 | A | 4/2002 |
| JP | 2002-225306 | A | 8/2002 |
| JP | 2002-370370 | A | 12/2002 |
| JP | 2005-170027 | A | 6/2005 |
| JP | 2005-349786 | A | 12/2005 |
| JP | 2007-112150 | A | 5/2007 |
| JP | 2008-246896 | A | 10/2008 |
| JP | 2009-061785 | A | 3/2009 |
| JP | 2009-241608 | A | 10/2009 |
| JP | 2010-005957 | A | 1/2010 |
| JP | 2011-110712 | A | 6/2011 |
| JP | 2011-140189 | A | 7/2011 |
| JP | 2011-207066 | A | 10/2011 |
| JP | 2012-035489 | A | 2/2012 |
| JP | 2012-126100 | A | 7/2012 |
| JP | 2012-136039 | A | 7/2012 |
| WO | 98/55325 | A1 | 12/1998 |
| WO | 2008/056736 | A1 | 5/2008 |

* cited by examiner

METHOD FOR INJECTING PRINTING MATERIAL, INJECTION KIT, AND INJECTION DEVICE

CROSS-REFERENCE TO RELATED APPLICATIONS

This application claims priority to Japanese Application No. 2012-162705 filed on Jul. 23, 2012, Japanese Application No. 2012-162233 filed on Jul. 23, 2012, and Japanese Patent Application No. 2012-191386 filed on Aug. 31, 2012. The entire disclosures of Japanese Patent Application Nos. 2012-162705, 2012-162233 and 2012-191386 is hereby incorporated herein by reference.

BACKGROUND

1. Technical Field

The present invention relates to a technique for injecting a printing material into a cartridge.

2. Related Art

Conventionally, a technique which uses an ink cartridge (also simply referred to as a "cartridge") for containing ink has been known as a technique which supplies ink to a printer as an example of a printing device (for example, Japanese Unexamined Patent Application Publication No. 2009-061785 and Japanese Unexamined Patent Application Publication No. 2005-349786). Such a cartridge is manufactured by injecting ink into a printing material containing chamber for containing ink. The above mentioned publications also disclose a technique in which a cartridge is reused by injecting ink into a used cartridge again so as to achieve the effective use of resources.

SUMMARY

There are cases in which a cartridge has an opening path for communicating the inside and the outside of a printing material supply port provided inside the printing material supply port for supplying ink to a printing device. When ink is injected into the printing material containing chamber of the cartridge, ink will enter the opening path and leak to the outside in some cases.

As described above, the need in a cartridge provided with an opening path is not limited to a cartridge for containing ink, but is common to a cartridge for containing another printing material or a printing material other than liquid. Also, in such a cartridge, reductions in size, reduction in cost, reduction in the use of resources, facilitation of manufacturing, improvements in usability, and the like have been desired.

The present invention has been made in order to at least partly solve the problems described above and can be achieved as the following aspects.

(1) According to an aspect of the present invention, there is proposed an injection method for injecting a printing material into a cartridge provided with a printing material containing chamber, a printing material supply port having an opening end, and an opening path through which the inside and the outside of the printing material supply port communicate each other, the opening path having an inner path including a communication port at an end portion, the inner path being provided inside the printing material supply port. The injection method comprises closing the inner path, and injecting the printing material into the printing material containing chamber through the printing material supply port after closing the inner path.

According to the injection method of this aspect, it is possible to prevent the printing material from leaking to the outside through the opening path by injecting the printing material after closing the inner path.

(2) The injection method of the aspect described above may further include sealing the opening end using a member having a flow path through which the outside and the inside of the printing material supply port communicate each other before the step of injecting the printing material.

According to the injection method of this aspect, it is possible to prevent the printing material from leaking to the outside through the opening end of the printing material supply port when injecting the printing material through the printing material supply port.

(3) According to another aspect of the present invention, there is proposed an injection method for injecting a printing material into a cartridge provided with a printing material containing chamber, a plurality of printing material supply ports having opening ends respectively, and an opening path through which the inside and the outside of each of the plurality of printing material supply ports communicate each other, the opening path having an inner path including a communication port at an end portion, the inner path being provided inside each of the plurality of printing material supply ports. The injection method comprises closing the inner path provided inside at least one printing material supply port among the plurality of printing material supply ports, and injecting the printing material into the printing material containing chamber through the at least one printing material supply port after closing the inner path.

According to the injection method of this aspect, even in a case where there are a plurality of printing material supply ports and inner paths, it is possible to prevent the printing material from leaking to the outside through the opening paths when injecting the printing material through the printing material supply ports.

(4) The injection method of the aspect described above may further include sealing the opening end of the at least one printing material supply port using a member having a flow path through which the outside and the inside of the printing material supply port communicate each other before the step of injecting the printing material.

According to the injection method of this aspect, even in a case where there are a plurality of printing material supply ports, it is possible to prevent the printing material from leaking to the outside through the opening ends of the printing material supply ports when injecting the printing material through the printing material supply ports.

(5) The injection method of the aspect described above may be applied to a case where the cartridge is provided with a detection member having a surface arranged inside the printing material containing chamber. In this injection method, the printing material may be injected into the printing material containing chamber until at least the surface of the detection member is immersed in the printing material in a state where the cartridge is mounted on the printing device.

According to the injection method of this aspect, in the state where the cartridge is mounted on the printing device (also referred to as a "mounting state"), the printing material is injected until the surface of the detection member is immersed in the printing material. Consequently, the remaining state of the printing material (the presence or absence of the printing material) can be detected using the detection member in the cartridge after injecting the printing material.

(6) The injection method of the aspect described above may further include discharging air in the printing material containing chamber to the outside through the printing material supply port in a state where the opening end is located above the printing material containing chamber, and the injecting the printing material and the discharging air may be conducted at least once, respectively.

According to the injection method of this aspect, it is possible to discharge air existing in the printing material containing chamber by including the step of discharging air. It is thus possible to reduce the amount of air existing in the printing material containing chamber after injecting the printing material.

(7) According to another aspect of the present invention, there is proposed an injection kit (an injection device) used for injecting a printing material into a cartridge provided with a printing material containing chamber, a printing material supply port having an opening end, and an opening path through which the inside and the outside of the printing material supply port communicates each other, the opening path having an inner path including a communication port at an end portion, the inner path being provided inside the printing material supply port. The injection kit (the injection device) includes a plug unit for closing the inner path, and an injection unit for injecting the printing material into the printing material containing chamber through the printing material supply port.

According to the injection kit (the injection device) of this aspect, it is possible to prevent the printing material from leaking to the outside of the cartridge through the opening path by closing the inner path with the plug unit when injecting the printing material through the printing material supply port.

(8) The injection kit (the injection device) of the aspect described above may further include a sealing unit which has a flow path communicating the outside and the inside of the printing material supply port and seals the opening end.

According to the injection kit (the injection device) of this aspect, it is possible to prevent the printing material from leaking to the outside of the cartridge through the opening end of the printing material supply port by sealing the opening end of the printing material supply port with the sealing unit when injecting the printing material through the printing material supply port.

(9) According to another aspect of the present invention, there is proposed an injection kit (an injection device) used for injecting a printing material into a cartridge provided with a printing material containing chamber, a plurality of printing material supply ports having opening ends respectively, and an opening path through which the inside and the outside of each of the plurality of printing material supply ports communicate each other, the opening path having an inner path including a communication port at an end portion, the inner path being provided inside each of the plurality of printing material supply ports. The injection kit (the injection device) includes a plug unit for closing the inner path provided inside each of the plurality of printing material supply ports, and an injection unit for injecting the printing material into the printing material containing chamber through at least one printing material supply port among the plurality of printing material supply ports.

According to the injection kit (the injection device) of this aspect, it is possible to prevent the printing material from leaking to the outside of the cartridge through the opening path even in a case of injecting the printing material into the cartridge which has a plurality of printing material supply ports and inner paths.

(10) The injection kit (the injection device) of the aspect described above may further include a sealing unit which seals the opening end of each of the plurality of printing material supply ports.

According to the injection kit (the injection device) of this aspect, it is possible to prevent the printing material from leaking to the outside of the cartridge through the opening end of the printing material supply port when injecting the printing material through the printing material supply port even in a case where the cartridge has a plurality of printing material supply ports.

(11) The injection kit (the injection device) of the aspect described above may include a discharging unit for discharging air in the printing material containing chamber to the outside through the printing material supply port.

According to the injection kit (the injection device) of this aspect, it is possible to discharge air existing in the printing material containing chamber by including the discharging unit. It is thus possible to reduce the amount of air existing in the printing material containing chamber after injecting the printing material.

(12) The injection kit (the injection device) of the aspect described above may include a switching unit for switching and repeatedly conducting injection of the printing material by the injection unit and discharge of air by the discharging unit.

According to the injection kit (the injection device) of this aspect, with the discharging unit, it is possible to repeatedly conduct injection of the printing material by the injection unit and discharge of air by the discharging unit. Consequently, even in a case where air enters the printing material containing chamber at the time of injection, the entering air can be discharged, and thus the amount of air existing in the printing material containing chamber of the cartridge can be reduced.

(13) The injection kit (the injection device) of the aspect described above may include a pressurizing unit for pressurizing and injecting the printing material into the printing material containing chamber through the printing material supply port.

According to the injection kit (the injection device) of this aspect, a predetermined amount of printing material can be injected into the printing material containing chamber of the cartridge for a short period of time with the pressurizing unit.

(14) The injection kit (the injection device) of the aspect described above may include an auxiliary unit for injecting the printing material into the printing material containing chamber through the printing material supply port by water head difference between the injection kit (the injection device) and the cartridge.

According to the injection kit (the injection device) of this aspect, the printing material can be injected automatically into the printing material containing chamber of the cartridge by setting the injection kit (the injection device) at the cartridge.

The plurality of constituent elements of each of the aspects of the present invention described above are not all essential and it is possible to appropriately perform modification, deletion, replacement with other new constituent elements, and deletion of a portion of limited content with regard to a portion of the plurality of constituent elements in order to solve a portion or all of the problems described above or to achieve a portion or all of the effects which are described in the present specification. In addition, an aspect which is independent of the present invention is possible by combining a portion or all of one technical aspect described above with a portion or all of the technical characteristics which are included in the other embodiments of the present invention described above in order to solve a portion or all of the problems described above or to achieve a portion or all of the effects which are described in the present specification.

For example, it is possible for one aspect of the present invention to be implemented as a method which includes one or more steps of the step of closing the inner path and the step of injecting the printing material. That is, the method may or may not have the step of closing the inner path. In addition, the method may or may not have the step of injecting the printing material. It is possible to implement such a method, for example, as a method for injecting a printing material, and also as a method other than a method for injecting a printing material. According to such an aspect, it is possible to solve at least one of the various problems such as reductions in size, reduction in cost, reduction in the use of resources, facilitation of manufacturing, and improvements in usability of the article. It is possible for a portion, all or any of the technical characteristics of each of the aspects of the method for injecting a printing material described above to be applied in such a method.

It is possible for the present invention to be implemented as various aspects other than the injection method, the injection kit, and the injection device. For example, it is possible for the invention to be implemented as aspects such as a cartridge, a method for manufacturing a cartridge, a method for manufacturing an injection kit, a method for manufacturing an injection device, a printing material system which is provided with a cartridge and a printing device, a printing material supply unit which is provided with a distribution tube for distributing liquid (printing material) to a cartridge and a printing device, and the like.

BRIEF DESCRIPTION OF THE DRAWINGS

Referring now to the attached drawings which form a part of this original disclosure.

DETAILED DESCRIPTION OF EXEMPLARY EMBODIMENTS

Next, embodiments of the present invention will be explained in the following order: A-C. Various Embodiments; and D. Modified Example.

A. First Embodiment

A-1. Configuration of Printing Material Supply System

Figure 1:
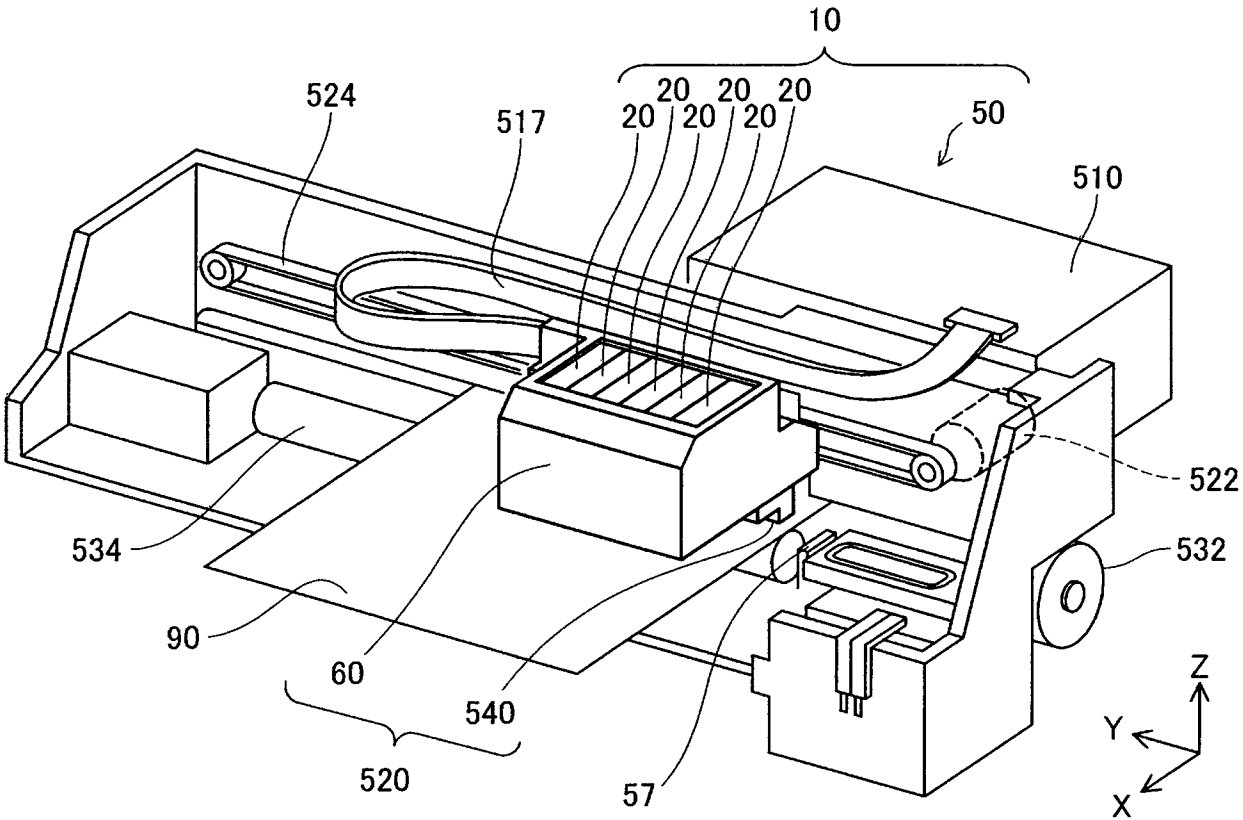
FIG. 1 is a perspective diagram illustrating a configuration of a printing material supply system.

FIG. 1 is a perspective diagram illustrating a configuration of a printing material supply system 10. X, Y, and Z axes are drawn to be orthogonal to each other in FIG. 1. The X, Y, and Z axes in FIG. 1 correspond to the X, Y, and Z axes in the other diagrams. The printing material supply system 10 is provided with a cartridge 20 and a printer 50 as a printing device. In the printing material supply system 10, the cartridge 20 is mounted on the holder 60 of the printer 50 such that the cartridge 20 can be attached and detached by the user.

The cartridge 20 of the printing material supply system 10 contains ink as a printing material (liquid) in the inside thereof. The ink contained in the cartridge 20 is supplied to a head 540 through a printing material supply port and a printing material supply pipe described later. In the present embodiment, a plurality of cartridges 20 are mounted on the holder 60 of the printer 50 to be able to be attached and detached. In the present embodiment, six kinds of cartridges 20 which correspond to ink of six colors (black, yellow, magenta, light magenta, cyan, and light cyan) respectively, that is, six cartridges 20 in total are mounted on the holder 60.

In other embodiments, the number of the cartridges which are mounted on the holder 60 may be six or less, or may be six or more. In other embodiments, the kind of ink of the cartridges 20 may be six colors or less, or may be six colors or more. In other embodiments, two or more cartridges 20 can be mounted on the holder 60 corresponding to ink of one color. Detailed configurations of the cartridge 20 and the holder 60 will be described later.

The printer 50 of the printing material supply system 10 is a small ink jet printer for an individual user. In addition to the holder 60, the printer 50 is provided with a control section 510, and a carriage 520 which has the holder 60. The carriage 520 is provided with the head 540. The printer 50 distributes ink from the cartridge 20 mounted on the holder 60 to the head 540 through the printing material supply pipe described later, and ejects (supplies) ink from the head 540 to a printing medium 90 such as paper or a label, thereby printing data such as text, a diagram, or an image onto the printing medium 90 using the head 540.

The control section 510 of the printer 50 controls each section of the printer 50. The carriage 520 of the printer 50 is configured to be able to relatively move the head 540 with regard to the printing medium 90. The head 540 of the printer 50 is provided with an ink ejecting mechanism which ejects ink contained the cartridge 20 to the printing medium 90. The control section 510 and the carriage 520 are electrically connected via a flexible cable 517, and the ink ejecting mechanism of the head 540 is operated based on a control signal from the control section 510.

A detection section 57 is provided in a position other than a printing region of the printer 50 so as to optically detect the remaining amount of ink in the cartridge 20. A light emitting section and a light receiving section are provided inside the detection section 57. When the cartridge 20 passes above the detection section 57 in accordance with movement of a carriage 520, a control section 510 causes the light emitting section of the detection section 57 to emit light, and the presence or absence of ink in the cartridge 20 is detected based on whether the light receiving section of the detection section 57 receives the light or not. Here, "the absence of ink" includes a state where only little ink remains.

In the present embodiment, the holder 60 is configured with the head 540 in the carriage 520. Such a type of printer 5Q in which the cartridge 20 is mounted on the holder 60 above the carriage 520 for moving the head 540 is also referred to as an "on-carriage type". In other embodiments, the immobile holder 60 may be configured in a portion which is different from the carriage 520, and the ink may be supplied from the cartridge 20 mounted on the holder 60 to the head 540 of the carriage 520 via a flexible tube. Such a type of printer is also referred to as an "off-carriage type".

In the present embodiment, the printer 50 is provided with a main scanning and feeding mechanism and a sub scanning and feeding mechanism for realizing printing with regard to the printing medium 90 by relatively moving the carriage 520 and the printing medium 90. The main scanning and feeding mechanism of the printer 50 is provided with a carriage motor 522 and a driving belt 524, and the carriage 520 is moved so as to reciprocate in the main scanning direction by motive force from the carriage motor 522 being transferred to the carriage 520 via the driving belt 524. The sub scanning and feeding mechanism of the printer 50 is provided with a transport motor 532 and a platen 534, and the printing medium 90 is transported in the sub scanning direction which is orthogonal to the main scanning direction by motive force from the transport motor 532 being transferred to the platen 534. The carriage motor 522 of the main scanning and feeding mechanism and the transport motor 532 of the sub scanning and feeding mechanism are operated based on control signals from the control section 510.

In the present embodiment, in the usage state (also referred to as the "usage position") of the printing material supply system 10, an axis along the sub scanning direction (front-back direction) where the printing medium 90 is transported is set as the X axis, an axis along the main scanning direction (horizontal direction) where the carriage 520 is moved so as to reciprocate is set as the Y axis, and an axis along the direction of gravity (vertical direction) is set as the Z axis. Here, the usage state of the printing material supply system 10 is a state of the printing material supply system 10 which is arranged on a horizontal surface, and in the present embodiment, the horizontal surface is a surface (XY plane) which is parallel to the X axis and the Y axis.

In the present embodiment, the sub scanning direction (forward direction) is the +X axial direction, the opposite direction thereof (backward direction) is the −X axial direction, the direction from below to above (upward direction) in the direction of gravity is the +Z axial direction, and the opposite direction thereof (downward direction) is the −Z axial direction. In the present embodiment, the +X axial direction side (front side) is the front surface of the printing material supply system 10. In the present embodiment, the direction from the right side surface toward the left side surface of the printing material supply system 10 is the +Y axial direction (leftward direction), and the opposite direction thereof is the −Y axial direction (rightward direction). In the present embodiment, the alignment direction of the plurality of cartridges 20 which are mounted on the holder 60 is the direction along the Y axis (the horizontal direction, also simply referred to as the "Y axial direction"). Here, the direction along the X axis (the front-back direction) is also referred to as the "X axial direction", and the direction along the Z axis (the vertical direction) is also referred to as the "Z axial direction".

A-2. Configuration of Holder

Figure 2:
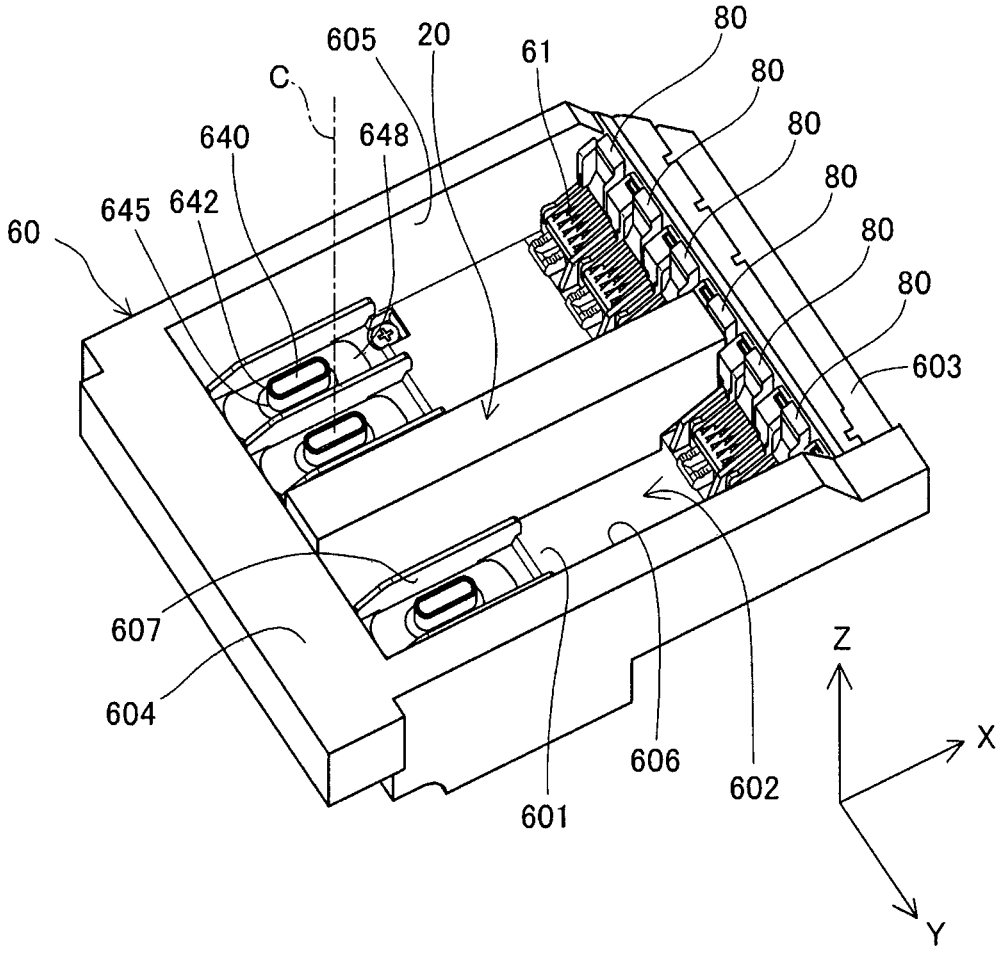
FIG. 2 is a first perspective diagram illustrating a holder where a cartridge is mounted.
Figure 3:
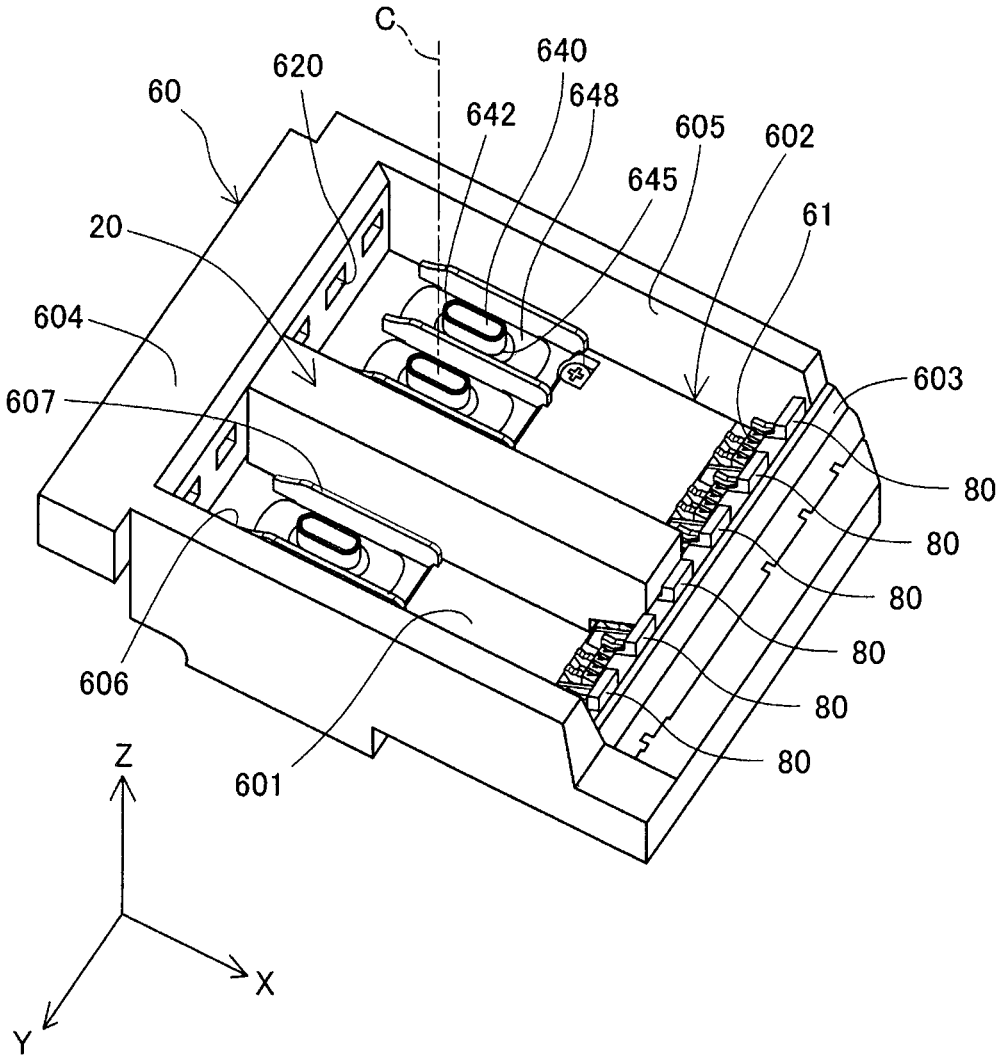
FIG. 3 is a second perspective diagram illustrating a holder where a cartridge is mounted.

FIG. 2 is a first perspective diagram illustrating the holder 60 where the cartridge 20 is mounted. FIG. 3 is a second perspective diagram illustrating the holder 60 where the cartridge 20 is mounted. FIG. 2 and FIG. 3 illustrate a state in which one cartridge 20 is mounted on the holder 60.

As shown FIG. 2 and FIG. 3, the holder 60 of the printer 50 has five wall sections 601, 603, 604, 605, and 606. A recessed portion formed by the five wall sections serves as a cartridge containing chamber 602 (also referred to as a "cartridge mounting section 602"). The cartridge containing chamber 602 is divided by partition walls 607 into a plurality of slots (mounting spaces) each of which can receive the cartridge 20. The partition wall 607 serves as a guide when the cartridge 20 is inserted into the slot. Each slot is provided with a printing material supply pipe 640, a contact mechanism 61, a lever 80, and a second device side restricting section 620 (FIG. 3). One side surface of each slot (side surface on the +Z axial direction side: upper surface) is opened, and the cartridge 20 is attached or detached with respect to the holder 60 through this opened side surface (upper surface). The printing material supply pipe 640 is provided to be sandwiched by the two partition walls 607.

The cartridge 20 is fastened by the lever 80 and the second device side restricting section 620, and is mounted on the holder 60 by connecting a printing material supply port described below with the printing material supply pipe 640. This state is referred to as a "state where the cartridge 20 is mounted on the holder 60", or a "mounting state". The printing material supply pipe 640 is in communication with the printing material supply port of the cartridge 20 and distributes ink contained in the cartridge 20 to the head 540. The printing material supply pipe 640 has a tip end section 642 (also referred to as a "connecting end section") which is located on the +Z axial direction side, and a base end section 645 which is located on the −Z axial direction side. The base end section 645 is provided at the bottom wall section 601. The tip end section 642 is connected with the printing material supply port of the cartridge 20. A central axis C of the printing material supply pipe 640 is parallel to the Z axis, and the direction from the base end section 645 toward the tip end section 642 along the central axis C is the +Z axial direction.

As shown in FIG. 2 and FIG. 3, an elastic member 648 is provided in the surroundings of the printing material supply pipe 640. The elastic member 648 tightly seals a printing material supply port of the carriage 20 in the mounting state. As a result of this, the elastic member 648 prevents ink from leaking from the printing material supply port to the surroundings. A pressing force Ps which includes components in the +Z axial direction is imparted from the elastic member 648 to the cartridge 20.

In the mounting state, various kinds of information is transmitted between the cartridge 20 and the printer 50 by electrically connecting a group of terminals provided on a circuit substrate of the cartridge 20 described below and the contact mechanism 61.

Although it is not shown in the drawing, a through hole is formed in the wall section 601 to optically detect the presence or absence of ink using the detection section 57. Light passes the through hole.

A-3. Outer Appearance Configuration of Cartridge

Figure 4:
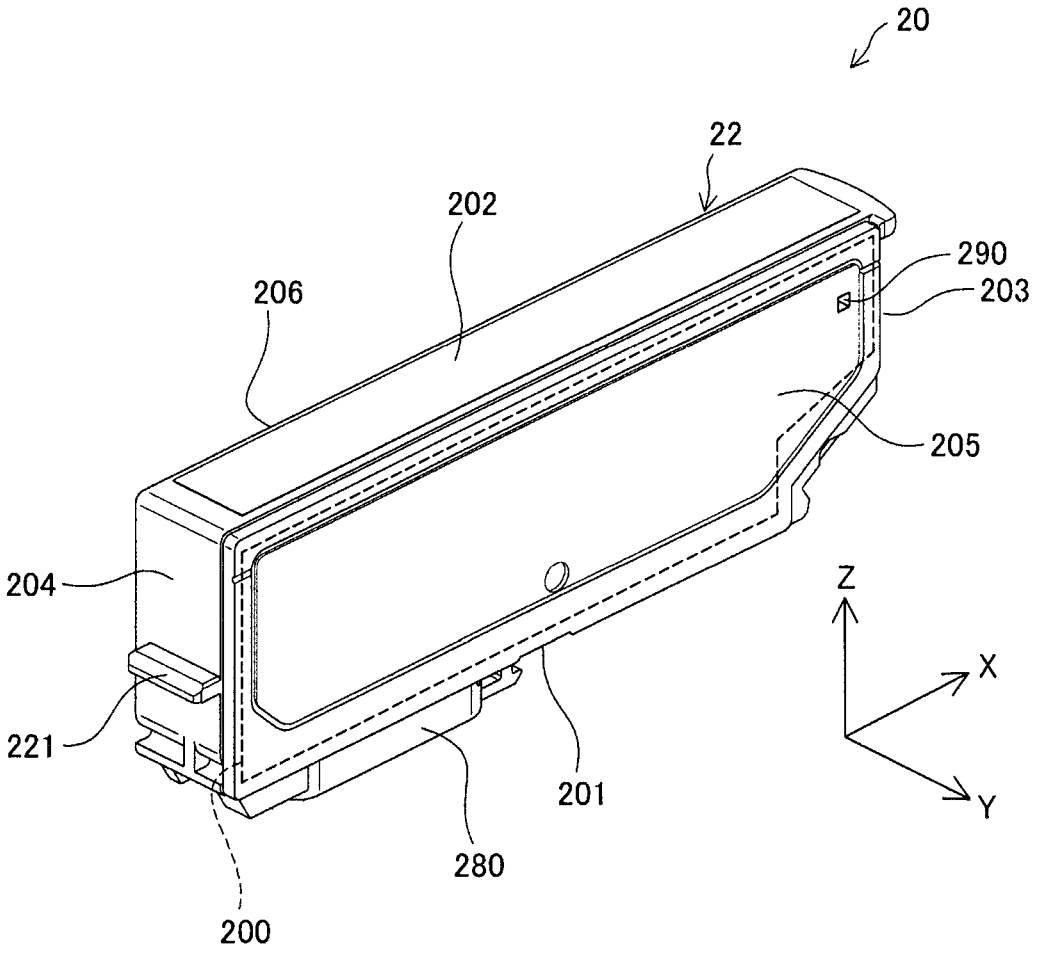
FIG. 4 is a first outer appearance perspective diagram of a cartridge.
Figure 5:
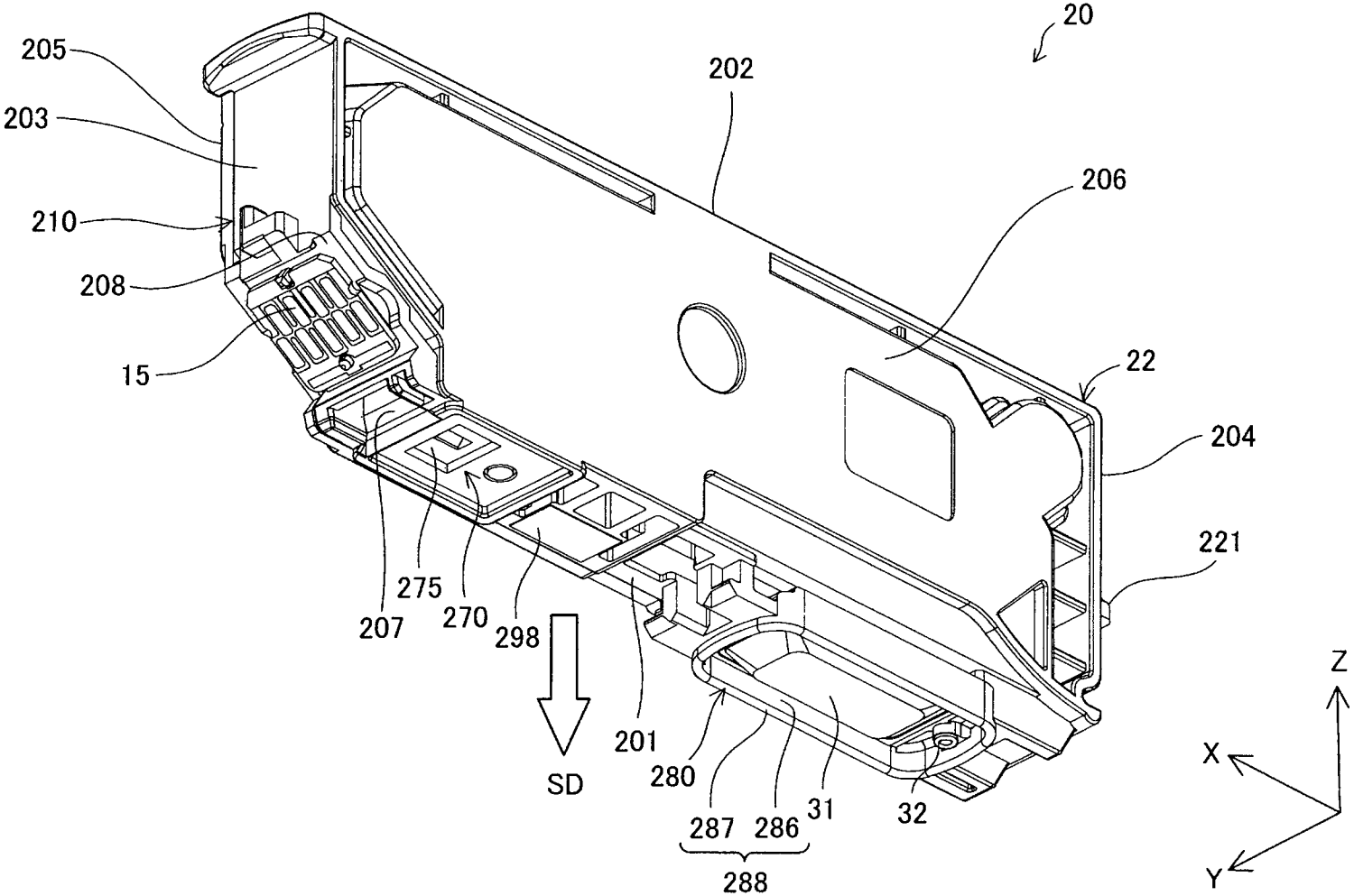
FIG. 5 is a second outer appearance perspective diagram of a cartridge.
Figure 6:
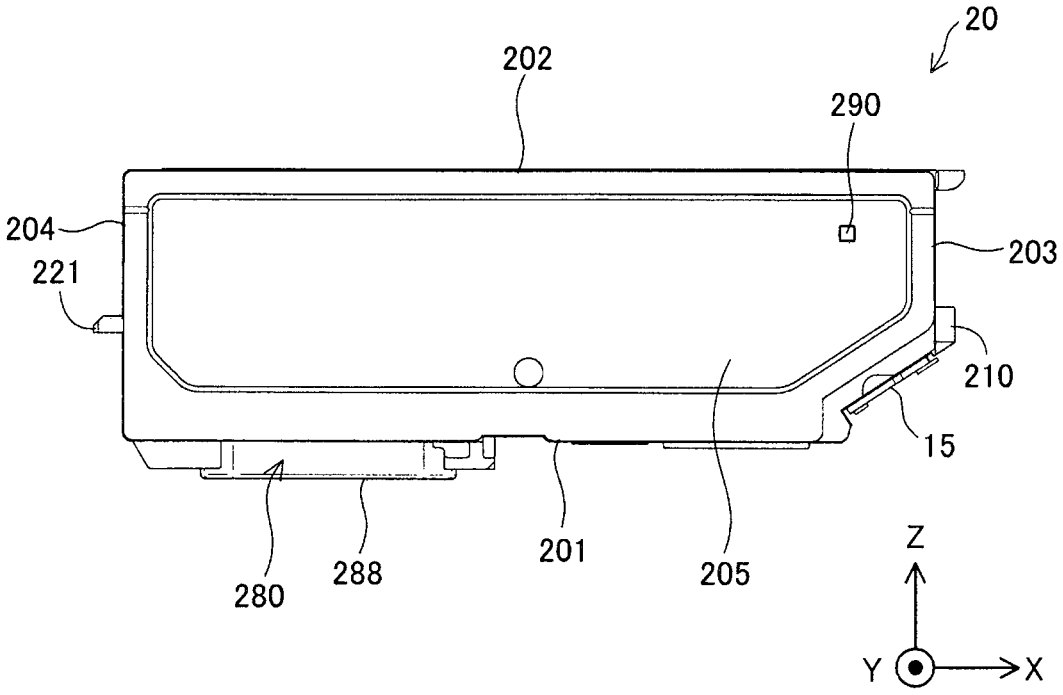
FIG. 6 is a left side surface diagram of a cartridge.
Figure 7:
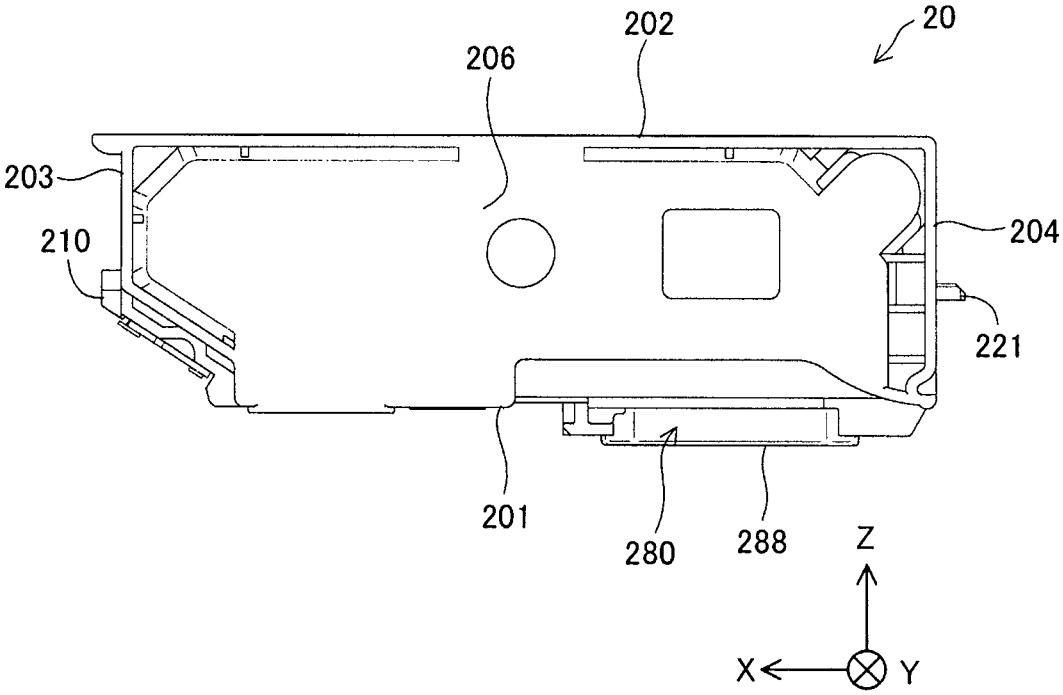
FIG. 7 is a right side surface diagram of a cartridge.
Figure 8:
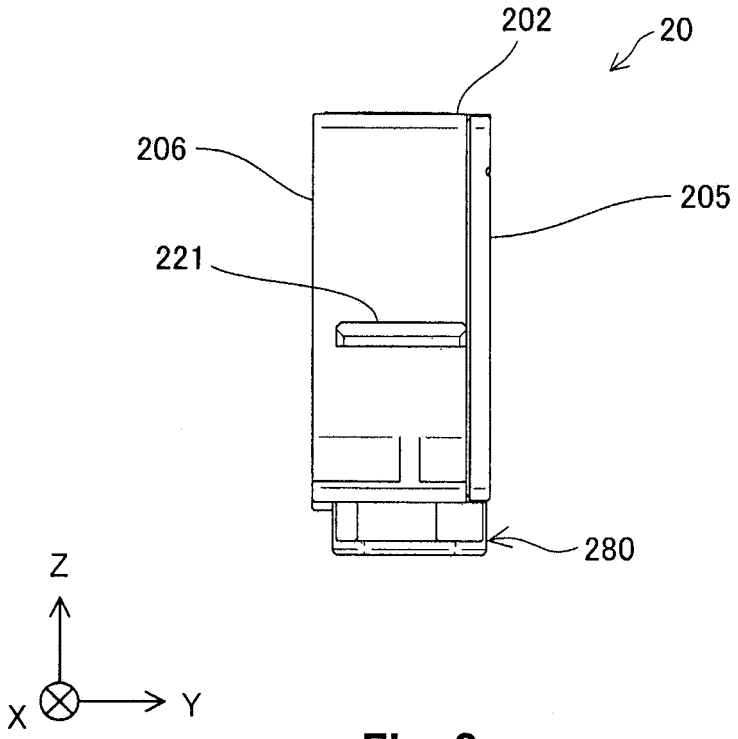
FIG. 8 is a rear surface diagram of a cartridge.
Figure 9:
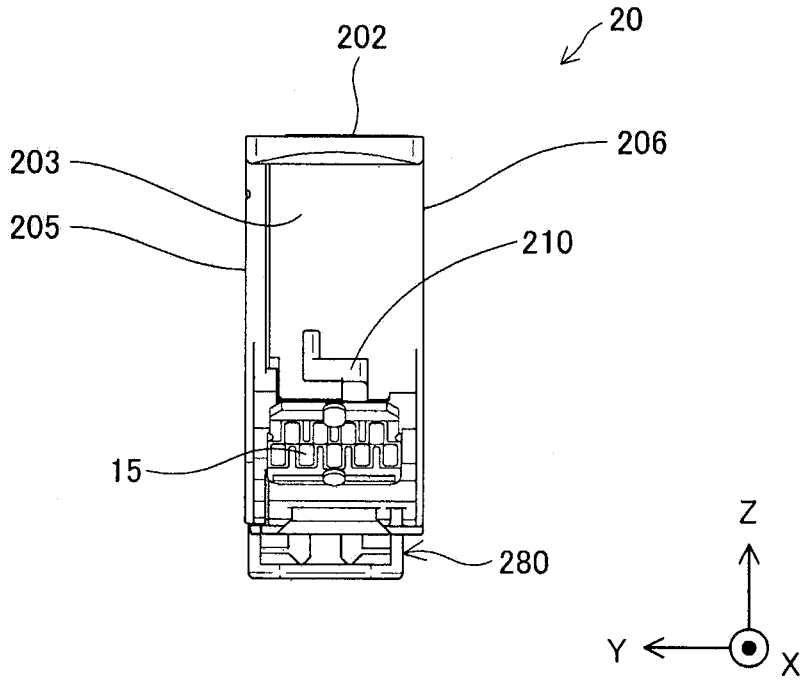
FIG. 9 is a front surface diagram of a cartridge.
Figure 10:
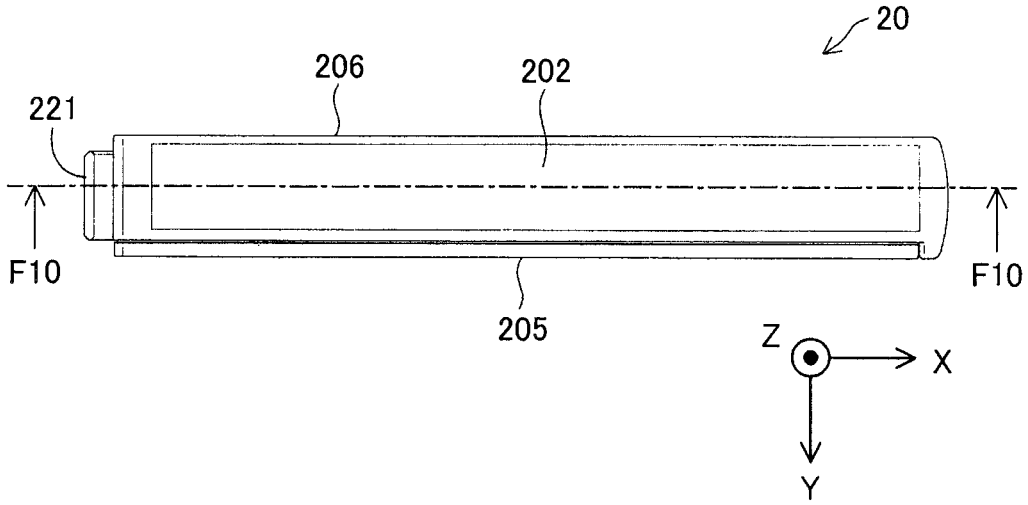
FIG. 10 is an upper surface diagram of a cartridge.
Figure 11:
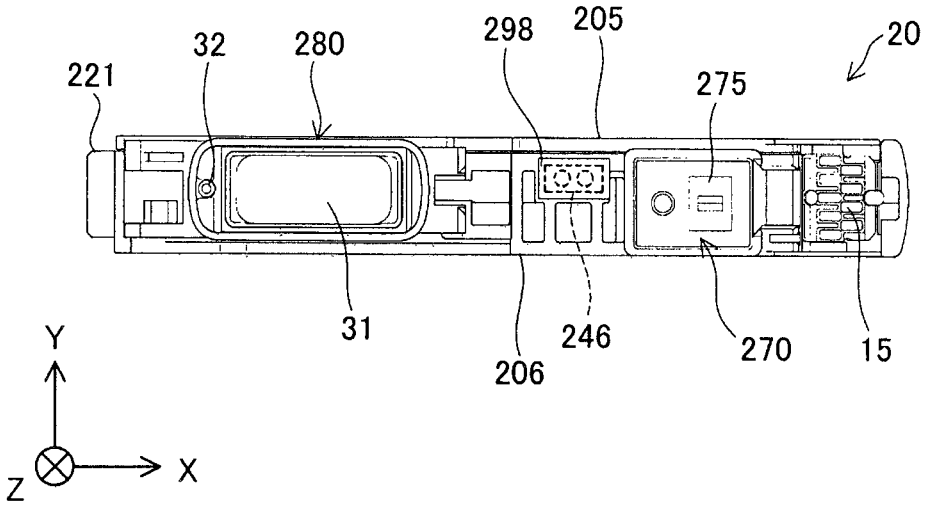
FIG. 11 is a bottom surface diagram of a cartridge.

FIG. 4 is a first outer appearance perspective diagram of the cartridge 20. FIG. 5 is a second outer appearance perspective diagram of the cartridge 20. FIG. 6 is a left side surface diagram of the cartridge 20. FIG. 7 is a right side surface diagram of the cartridge 20. FIG. 8 is a rear surface diagram of the cartridge 20. FIG. 9 is a front surface diagram of the cartridge 20. FIG. 10 is an upper surface diagram of the cartridge 20. FIG. 11 is a bottom surface diagram of the cartridge 20. The cartridge 20 of the present embodiment is a cartridge 20 of a semi-sealed type in which the outside air is introduced into a printing material containing chamber 200 intermittently as ink is consumed.

As shown in FIG. 4, the cartridge 20 is provided with the printing material containing chamber 200 for containing ink in the inside thereof, and the printing material supply port 280 for distributing ink in the printing material containing chamber 200 to the printer 50 in the outside.

As shown in FIG. 4 and FIG. 5, the cartridge 20 is provided with an outer shell 22 which has a substantially cuboidal shape. The cartridge 20 has six surfaces 201 to 206 as six wall sections which configure the outer shell 22. The six surfaces are constructed of a first surface 201 (bottom surface 201), a second surface 202 (upper surface 202), a third surface 203 (front surface 203), a fourth surface 204 (rear surface 204), a fifth surface 205 (left side surface 205), and a sixth surface 206 (right side surface 206). As shown in FIG. 5, the cartridge 20 has a seventh surface 207 and an eighth surface 208 along with the six surfaces. Each of the first surface 201 to the eighth surface 208 is a substantially flat surface. The substantially flat surface includes a case in which the entire area of the surface is completely flat, and a case in which there are irregularities in a part of the surface. That is, the substantially flat surface includes a case in which the surface or the wall of the outer shell 22 of the cartridge 20 can be identified even if there are slight irregularities in a part of the surface. The outer shape of each of the first surface 201 to the eighth surface 208 in the planar view is a rectangle. In the present embodiment, the first surface 201 to the eighth surface 208 may be outer surfaces of an assembly which is assembled from a plurality of members. In the present embodiment, each of the first surface 201 to the eighth surface 208 is made of a plate-shaped member. In other embodiments, a part of the first surface 201 to the eighth surface 208 may be made of a film-shaped (thin-film-shaped) member. For example, each of the first surface 201 to the eighth surface 208 is made of synthetic resin such as polyacetal (POM) or the like.

In the present embodiment, comparing the length (length in the X axial direction), the width (length in the Y axial direction), and the height (length in the Z axial direction) of the cartridge 20 in terms of the size, the length is larger than the height, and the height is larger than the width. It is possible to arbitrarily change the size relationship of the length, the width, and the height of the cartridge 20. For example, the height may be larger than the length, and the length may be larger than the width. Alternatively, the height, the length, and the width may be the same.

As shown in FIG. 4 and FIG. 5, the first surface 201 and the second surface 202 are surfaces which are parallel to the X axis and the Y axis. The first surface 201 and the second surface 202 oppose each other in the Z axial direction. The first surface 201 is positioned on the −Z axial direction side, and the second surface 202 is positioned on the +Z axial direction side. The first surface 201 and the second surface 202 have a positional relationship so as to intersect with the third surface 203, the fourth surface 204, the fifth surface 205, and the sixth surface 206. The third surface 203 and the fourth surface 204 are surfaces which are parallel to the Y axis and the Z axis. The third surface 203 and the fourth surface 204 oppose each other in the X axial direction. The third surface 203 is positioned on the +X axial direction side, and the fourth surface 204 is positioned on the −X axial direction side. The fifth surface 205 and the sixth surface 206 are surfaces which are parallel to the X axis and the Z axis. The fifth surface 205 and the sixth surface 206 oppose each other in the Y axial direction. Here, in the present specification, "intersecting" of two surfaces means any one of a state where two surfaces intersect by being linked to each other, a state where an extended surface of one of the surfaces intersects with the other surface, and a state where extended surfaces intersect with each other. In the present embodiment, the first surface 201 configures the bottom surface of the cartridge 20 and the second surface 202 configures the upper surface of the cartridge 20 in the mounting state where the cartridge 20 is mounted on the holder 60. As shown in FIG. 5, the seventh surface 207 and the eighth surface 208 link the first surface 201 and the third surface 203. The seventh surface 207 is connected with the first surface 201, and the eighth surface 208 is connected with the third surface 203.

As shown in FIG. 4 and FIG. 5, the printing material supply port 280 is provided to protrude from the first surface 201. The printing material supply port 280 extends from the first surface 201 in the −Z axial direction. As shown in FIG. 5, the printing material supply port 280 has an opening end 288 in an end portion. The opening end 288 has an opening 286 and a partition end section 287 which defines the opening 286. The opening 286 formed by the opening end 288 is positioned on the plane perpendicular to the direction in which the printing material supply port 280 protrudes (−Z axial direction). That is, the opening 286 is formed along the plane parallel to the X axis and the Y axis.

As shown in FIG. 5 and FIG. 11, a printing material exit 31 is provided inside the printing material supply port 280 such that ink distributing from the printing material containing chamber 200 to the inside of the printing material supply port 280 flows to the outside. The printing material exit 31 contacts the tip end section 642 of the printing material supply pipe 640 in the mounting state. As a result of this, ink is distributed to the printing material supply pipe 640 through the printing material exit 31. The printing material exit 31 is made of a porous sheet member which can distribute ink.

As shown in FIG. 5 and FIG. 11, a communication port 32 is formed inside the printing material supply port 280 as an opening for communicating the inside and the outside of the printing material supply port 280. The communication port 32 is provided on the downstream side with respect to the printing material exit 31 in an ink flow direction (−Z axial direction) of the printing material supply port 280. Further, the communication port 32 is provided in a position in which the communication port 32 does not overlap with the printing material exit 31 when the cartridge 20 is vertically projected on the first surface 201. A region (internal space) inside the printing material supply port 280 in which air exists is in communication with the outside (outside air) via the communication port 32 so as to keep the pressure difference between the internal space and the outside to be substantially uniform.

As shown in FIG. 5 and FIG. 11, a prism unit 270 is provided on the first surface 201. The prism unit 270 is provided with a so-called right angle prism 275. The right angle prism 275 of the prism unit 270 has two surfaces (not shown in the drawing) which intersect substantially at a right angle. These two surfaces are positioned inside the printing material containing chamber 200. In the present embodiment, the presence or absence of ink is determined in the control section 510 of the printer 50 shown in FIG. 1. This determination is made as follows based on exchange of light between the detection section 57 of the printer 50 shown in FIG. 1 and the prism 275 of the cartridge 20 shown in FIG. 5 and FIG. 11. First, light is emitted from the light emitting section of the detection section 57 toward one of the two surfaces of the prism 275. At this time, in a case where the vicinity of the prism 275 is filled with ink, most of light emitted from the light emitting section of the detection section 57 passes through the surface, and does not reach the light receiving section of the detection section 57. On the other hand, in a case where there is no ink in the vicinity of the prism 275, most of light emitted from the light emitting section is reflected on the surface of the prism 275. This reflected light is reflected on the other surface of the prism 275 toward the detection section 57, and reaches the light receiving section of the detection section 57. In this manner, in a case where the light receiving section of the detection section 57 does not detect light of a predetermined level or more, "the presence of ink" is determined in the control section 510 of the printer 50, and in a case where the light receiving section of the detection section 57 detects light of a predetermined level or more, "the absence of ink" is determined in the control section 510 of the printer 50. Here, "the absence of ink" includes a state where only little ink remains. As described above, the surface of the prism 275 as the detection member is positioned inside the printing material containing chamber 200, in which the reflection state of light on the surface varies depending on the refractive index of fluid contacting the surface.

As shown in FIG. 5 and FIG. 11, a sheet member 298 is attached to a position of the first surface 201 between the printing material supply port 280 and the prism unit 270. The sheet member 298 is a member for forming a part 246 (also referred to as a "connecting path 246", FIG. 11) of a flow path inside the printing material containing chamber 200. The connecting path 246 is positioned between the prism unit 270 and the printing material supply port 280 in a flow direction inside the printing material containing chamber 200 toward the printing material supply port 280.

As shown in FIG. 5 and FIG. 9, a first cartridge side restricting section 210 of a protrusion shape is formed on the third surface 203. The first cartridge side restricting section 210 is fastened to the lever 80 in the mounting state. As shown in FIG. 4 and FIG. 8, a second cartridge side restricting section 221 of a protrusion shape is formed on the fourth surface 204. The second cartridge side restricting section 221 is inserted into the second device side restricting section 620 (FIG. 3) which is a through hole formed in the wall section 604 (FIG. 2), and is fastened thereto in the mounting state. Specifically, the position of the cartridge 20 is determined with respect to the holder 60 by fastening the cartridge 20 on both sides in the X axial direction by the lever 80 and the second device side restricting section 620 of the holder 60 in the mounting state.

As shown in FIG. 5, a circuit substrate 15 is provided on the eighth surface 208. A plurality of terminals which contact the contact mechanism 61 in the mounting state is formed on the surface of the circuit substrate 15. A storage device for storing various kinds of information of the cartridge 20 (the presence or absence of ink, color of ink, and the like) is provided on the back surface of the circuit substrate 15.

As shown in FIG. 4, a ventilation port 290 is formed in the fifth surface 205 to introduce air into the inside of the cartridge 20.

A-4. Summary of Internal Configuration and Operation of Cartridge

Figure 12:
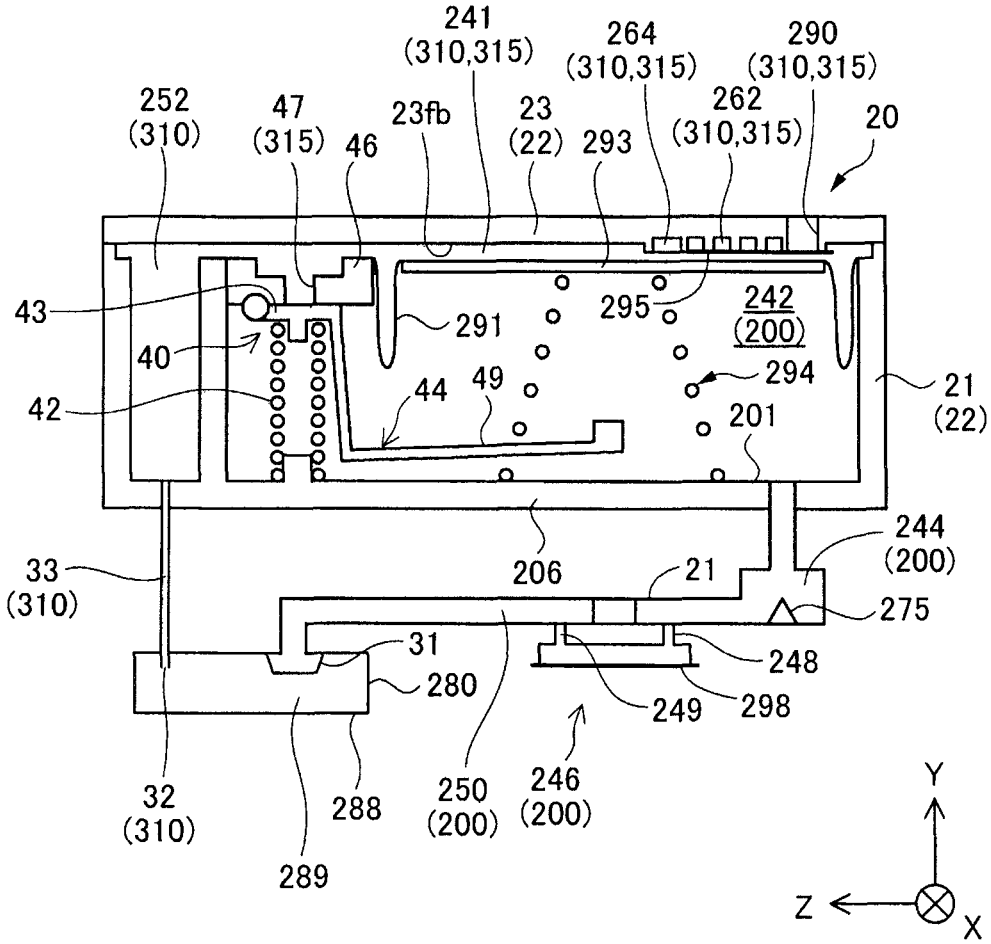
FIG. 12 is a first diagram for explaining a cartridge.
Figure 13:
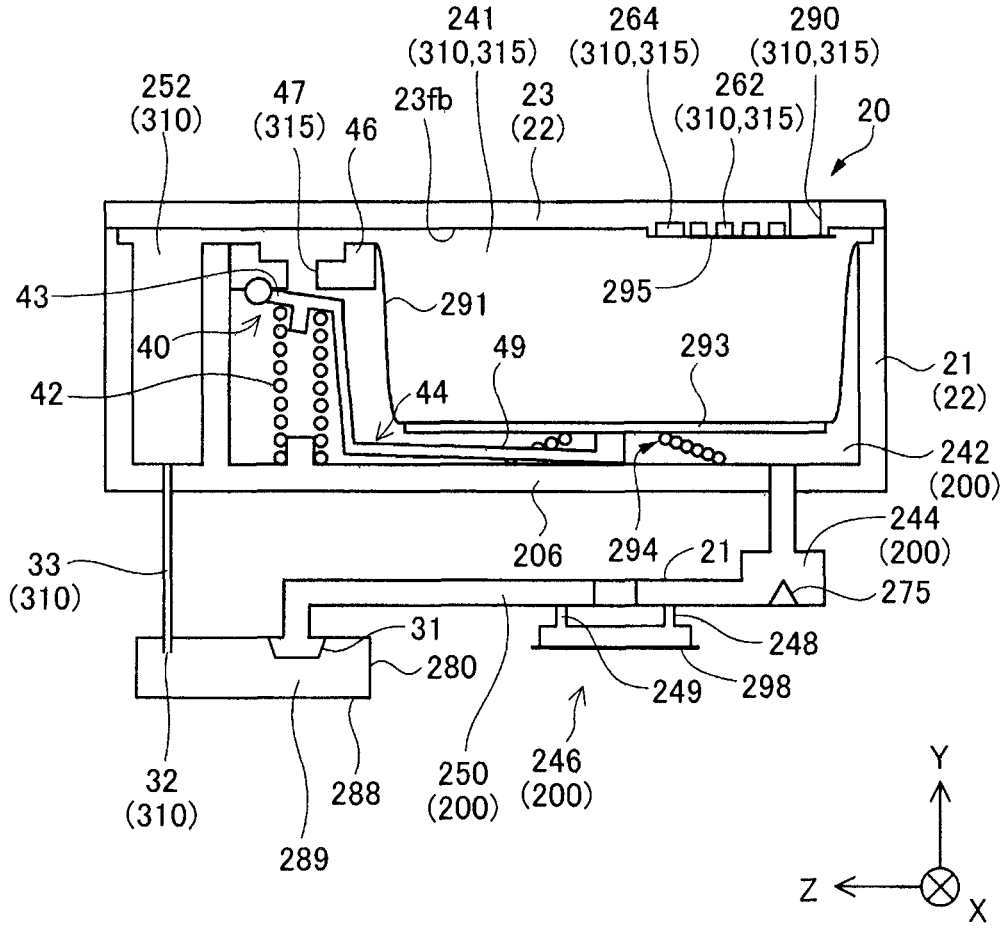
FIG. 13 is a second diagram for explaining a cartridge.
Figure 14:
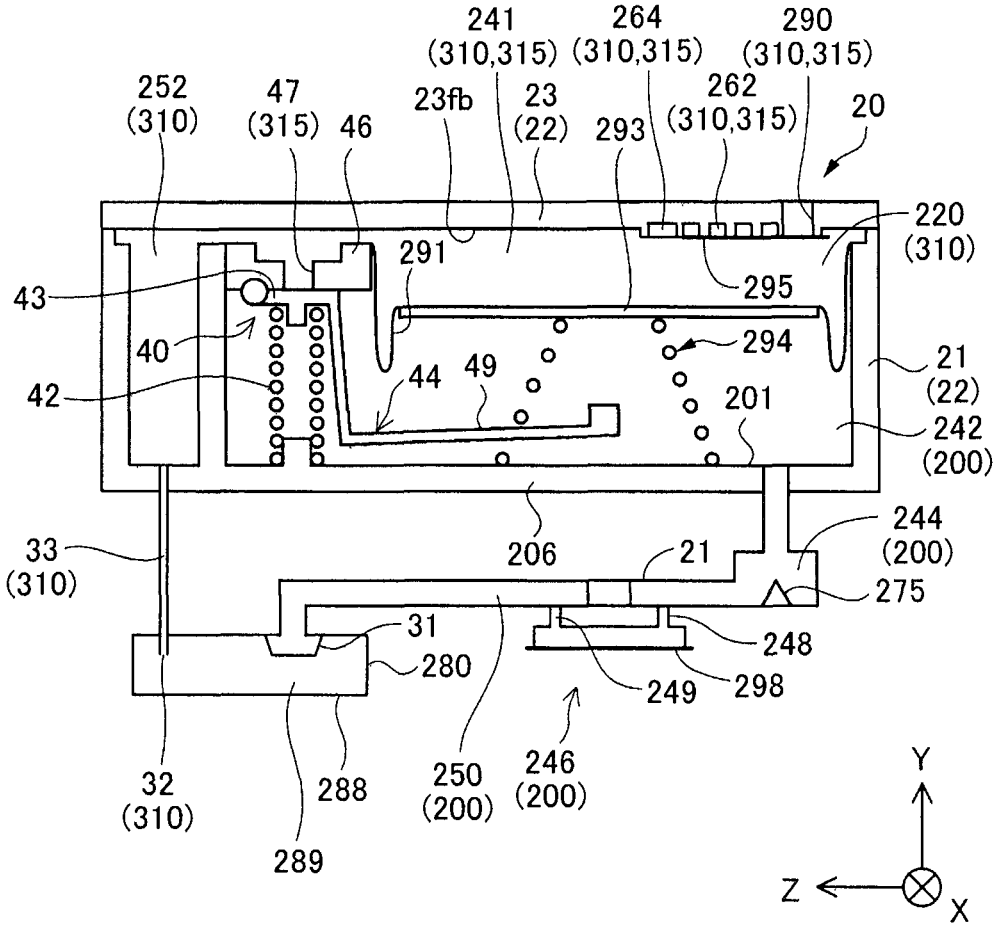
FIG. 14 is a third diagram for explaining a cartridge.

FIG. 12 is a first diagram for explaining the cartridge 20. FIG. 13 is a second diagram for explaining the cartridge 20. FIG. 14 is a third diagram for explaining the cartridge 20. FIG. 12 to FIG. 14 are schematic diagrams for explaining the internal state of the cartridge 20.

As shown in FIG. 12, the outer shell 22 of the cartridge 20 has a container main body member 21 and a lid member 23. The internal space is formed by attaching the lid member 23 to close the opening of the container main body member 21. The cartridge 20 is provided with a first communication path 315, and a second communication path 310 as the opening path. Both of the first communication path 315 and the second communication path 310 are flow paths through which air passes. The cartridge 20 is also provided with the printing material containing chamber 200. The printing material containing chamber 200 is divided by the container main body member 21 and a first sheet member 291. The sheet member 291 is a member which has flexibility. Air is introduced into the printing material containing chamber 200 at a predetermined timing through the first communication path 315. An air introduction port 47 serves as an entrance for taking air into the printing material containing chamber 200. The cartridge 20 has a valve mechanism 40 for opening and closing the air introduction port 47.

A pressure receiving plate 293 is provided inside the printing material containing chamber 200, and the front surface (surface on the +Y axial direction side) of the pressure receiving plate 293 is opposed to the first sheet member 291. Further, a coil spring 294 is provided inside the printing material containing chamber 200 as a first pressing member for pressing the first sheet member 291 from the back surface (surface on the −Y axial direction side) of the pressure receiving plate 293 in a direction of expanding the volume of the printing material containing chamber 200. As a result of this, the pressure inside the printing material containing chamber 200 is maintained at pressure lower than the atmospheric pressure (negative pressure). The center of gravity of the pressure receiving plate 293 is located inside a region in which the coil spring 294 abuts against the pressure receiving plate 293 in a case where the cartridge 20 is vertically projected on the opposite wall 206.

The printing material containing chamber 200 is provided with a main chamber 242, a detection chamber 244, the connecting path 246, and a buffer chamber 250. Ink flows from the main chamber 242 on the upstream side through the detection chamber 244, the connecting path 246, and the buffer chamber 250 in this order, and reaches the printing material supply port 280 on the downstream side. The main chamber 242 is a part in which the coil spring 294 is provided.

The detection chamber 244 is a part in which the prism 275 (FIG. 5 and FIG. 11) is provided. The connecting path 246 is a flow path which links the buffer chamber 250 and the detection chamber 244. The connecting path 246 is a flow path which is formed by a wall constructing the first surface 201 and the sheet member 298 (FIG. 11). The connecting path 246 is a flow path for preventing backflow of ink from the connecting path 246 toward a flow path on the upstream side (for example, the detection chamber 244). The connecting path 246 has retaining flow paths 248, 249 which can retain ink by forming meniscus. The retaining flow paths 248, 249 have a shape which does not have a corner portion in the cross section of the flow path. It is thus possible to reduce the possibility that ink in the buffer chamber 250 will flow back to the upstream side due to capillary force. For example, a case in which a slight amount of ink remains inside the printing material containing chamber 200 and ink exists only in the buffer chamber 250 is assumed. In such a case, if ink flows back from the buffer chamber 250 to the detection chamber 244, it will cause false detection of the presence or absence of ink. Also, if ink flows back from the buffer chamber 250 to the detection chamber 244, it will cause air bubbles to enter the buffer chamber 250 and cause air bubbles to flow into the printer 50. However, since the retaining flow paths 248, 249 can prevent backflow of ink, the occurrence of the above-described problems can be reduced. In the present embodiment, the retaining flow paths 248, 249 are columnar flow paths. The buffer chamber 250 is a flow path which is in communication with the printing material supply port 280.

The first communication path 315 is an air introduction path for introducing the outside air into the printing material containing chamber 200. The ventilation port 290 (also referred to as the "outside air introduction port 290") is formed in an end portion of the first communication path 315, and the air introduction port (also referred to as the "inside air introduction port 47") is formed in the other end portion of the first communication path 315. The ventilation port 290 is an opening which is formed to penetrate the lid member 23. The air introduction port 47 is an opening for taking air into the printing material containing chamber 200. The air introduction port 47 is opened and closed by the valve mechanism 40. The detail of the valve mechanism 40 will be described later.

When the ventilation port 290 is considered to be on the upstream side and the air introduction port 47 is considered to be on the downstream side, the first communication path 315 is provided with the ventilation port 290, an inner communication path 262, a communication section 264, an air chamber 241, and the air introduction port 47 in this order from the upstream side. Here, the "upstream" and the "downstream" used for explaining the configuration of the first communication path 315 is based on a flow direction of air passing from the ventilation port 290 toward the air introduction port 47.

The inner communication path 262 is a flow path one end portion of which is connected with the ventilation port 290 and the other end portion of which is connected with the communication section 264. The inner communication path 262 is a flow path which is formed on an opposite surface 23*fb* side of the lid member 23, and the opposite surface 23*fb* is opposed to the first sheet member 291. The inner communication path 262 is constructed of a groove section formed on the opposite surface 23*fb* and a sheet member 295 (also referred to as a "second sheet member 295") attached to the opposite surface 23*fb* so as to cover the groove section. The second sheet member 295 is arranged in a position in which at least a part of the second sheet member 295 is opposed to the first sheet member 291. Also, the inner communication path 262 is a meandering path.

The communication section 264 is connected with a downstream end portion of the inner communication path 262. The communication section 264 introduces air, which flows through the inner communication path 262, into the air chamber 241. The communication section 264 is provided to be recessed on the opposite surface 23*fb* which is opposed to the first sheet member 291 of the lid member 23. That is, the communication section 264 is a recessed portion formed on the opposite surface 23*fb*. The air chamber 241 is a space formed between the lid member 23 and the first sheet member 291. In other words, the air chamber 241 is a space sandwiched by the lid member 23 and the first sheet member 291. The air introduction port 47 is an opening formed in a cover valve 46 of the valve mechanism 40.

The second communication path 310 connects a space 289 (a space 289 in which the communication port 32 is arranged) on the downstream side with respect to the printing material exit 31 of the printing material supply port 280 with the outside of the cartridge 20. The second communication path 310 connects the printing material supply port 280 (in more detail, the space 289) with the outside through the communication port 32 which is an opening end different from the opening end 288 of the printing material supply port 280. In a case where the printing material supply port 280 is closed by a member such as a cap, for example, the space 289 is partitioned by such a separate member which closes the supply port 280, and the printing material supply port 280. In this manner, when the supply port 280 is closed by a separate member, one closed chamber is formed inside the supply port 280, and thus this space 289 is also referred to as the inner chamber 289. Here, the elastic member 648 (FIG. 3) of the holder 60 abutting against the partition end section 287 of the opening end 288 in the mounting state can serve as the separate member for closing the supply port 280 instead of the cap.

One end portion (one opening end) of the second communication path 310 is the communication port 32 which is provided in the inner chamber 289, and the other end portion (the other opening end) is the ventilation port 290 which is formed to penetrate the lid member 23. When the communication port 32 is considered to be on the upstream side and the ventilation port 290 is considered to be on the downstream side, the second communication path 310 is provided with the communication port 32, an inner path 33, a flow path chamber 252, the air chamber 241, the communication section 264, the inner communication path 262, and the ventilation port 290. Among these elements, the air chamber 241, the communication section 264, the inner communication path 262, and the ventilation port 290 are elements common to the first communication path 315. Specifically, the downstream side portion of the second communication path 310 and the upstream side portion of the first communication path 315 are shared. The air chamber 241, the communication section 264, the inner communication path 262, and the ventilation port 290 serve as a flow path for introducing air from the outside to the inside of the cartridge in the first communication path 315, and serve as a flow path for discharging air from the inside to the outside of the cartridge in the second communication path 310. The "upstream" and the "downstream" used for explaining the configuration of the second communication path 310 is based on a flow direction of fluid (air) passing from the communication port 32 toward the ventilation port 290.

The inner path 33 is formed inside the printing material supply port 280. The inner path 33 is a flow path which penetrates a wall defining the printing material supply port 280 and leads to the flow path chamber 252. An end portion on the upstream side of the inner path 33 forms the communication port 32. The flow path chamber 252 is a space formed in the container main body member 21. An end portion on the upstream side of the flow path chamber 252 is connected with the inner path 33, and an end portion on the downstream side of the flow path chamber 252 is connected with air chamber 241. The inner path 33 serves as a path for connecting the printing material supply port 280 and the air chamber 241 through the flow path chamber 252.

With the second communication path 310, even in a case where the opening end 288 of the printing material supply port 280 is closed by a separate member, the pressure in the space 289 can be maintained to be substantially uniform with respect to the outside pressure. Consequently, it is possible to reduce occurrence of ink leakage from the printing material supply port 280 caused by pressure change in the space 289.

For example, when the cartridge 20 is mounted in the printer 50 (at the time of mounting operation), the elastic member 648 (FIG. 2) of the holder 60 tightly seals the surroundings of the opening end 288 of the printing material supply port 280. Here, when the surroundings of the opening end 288 is tightly sealed, a part of the elastic member 648 digs into the printing material supply port 280, thereby decreasing the volume of the printing material supply port 280 and increasing the pressure inside the printing material supply port 280. Generally, the flow path from the printing material containing chamber 200 to the printing material exit 31 has a portion in which the flow path resistance is high so that ink will not leak from the printing material exit 31 to the outside. In the present embodiment, the flow path resistance is made high with a sheet member provided inside the printing material supply port 280 described below, or a foam. Therefore, in a state immediately after the surroundings of the opening end 288 are tightly sealed and the volume of the printing material supply port 280 decreases, air will not be sufficiently distributed to the printing material containing chamber 200 by the reduced amount. However, the reduced amount of air can be discharged to the outside by the second communication path 310, and the pressure of the outside and the printing material supply port 280 can be maintained to be substantially uniform.

If the second communication path 310 were not provided in the cartridge 20, compressed air in the printing material supply port 280 would gradually flow into the printing material containing chamber 200 after mounting the cartridge 20, for example. As a result of this, unexpected air would enter the printing material containing chamber 200, resulting in the possibility that the pressure inside the printing material containing chamber 200 cannot be maintained in an appropriate pressure range. Also, when air in the printing material supply port 280 flows into the printing material containing chamber 200 until the increased pressure in the printing material supply port 280 and the pressure in the printing material containing chamber 200 become balanced, the pressure in the printing material containing chamber 200 increases compared to a state before air enters. In a case where the user detaches the cartridge 20 from the holder 60 in this state, the pressure in the printing material supply port 280 becomes the atmospheric pressure. That is, the pressure in the printing material supply port 280 decreases, and ink will leak to the outside through the printing material supply port 280 from the printing material containing chamber 200 in which the pressure is high.

The valve mechanism 40 is provided with the cover valve 46, a lever valve 44, and a coil spring 42 as a pressing member. The lever valve 44 is pressed onto the cover valve 46 by the coil spring 42 so as to close the air introduction port 47 which is a through hole. The lever valve 44 is provided with a lever section 49 which abuts by displacement of the pressure receiving plate 293, and a valve section 43 for closing the air introduction port 47.

Next, the operation of the cartridge 20 will be explained. As shown in FIG. 12, the printing material containing chamber 200 is filled with ink in an initial state (unused state) of the cartridge 20.

As shown in FIG. 13, when the ink in the printing material containing chamber 200 is consumed and the pressure receiving plate 293 comes closer to the sixth surface 206 side, the pressure receiving plate 293 presses the lever section 49 toward the sixth surface 206 side. Then, the valve section 43 is separated from the air introduction port 47, and the printing material containing chamber 200 is temporarily in communication with the outside air. That is, the lever valve 44 is placed into an open valve state. Then, the outside air flows into the printing material containing chamber 200 through the first communication path 315. Consequently, as shown in FIG. 14, the volume of the printing material containing chamber 200 becomes larger by the amount of the introduced air. At the same time, the negative pressure in the printing material containing chamber 200 becomes slightly small (close to the atmospheric pressure). Then, as shown in FIG. 14, when a certain amount of air is introduced into the printing material containing chamber 200, the pressure receiving plate 293 is separated from the lever section 49. Consequently, the valve section 43 closes the air introduction port 47 again. That is, the lever valve 44 is placed into a close valve state. In this manner, when the negative pressure of the printing material containing chamber 200 becomes larger as the ink in the printing material containing chamber 200 is consumed, the lever valve 44 is temporarily placed into an open valve state, thereby making it possible to maintain the pressure in the printing material containing chamber 200 in an appropriate pressure range.

A-5. Detailed Configuration of Cartridge

Figure 15:
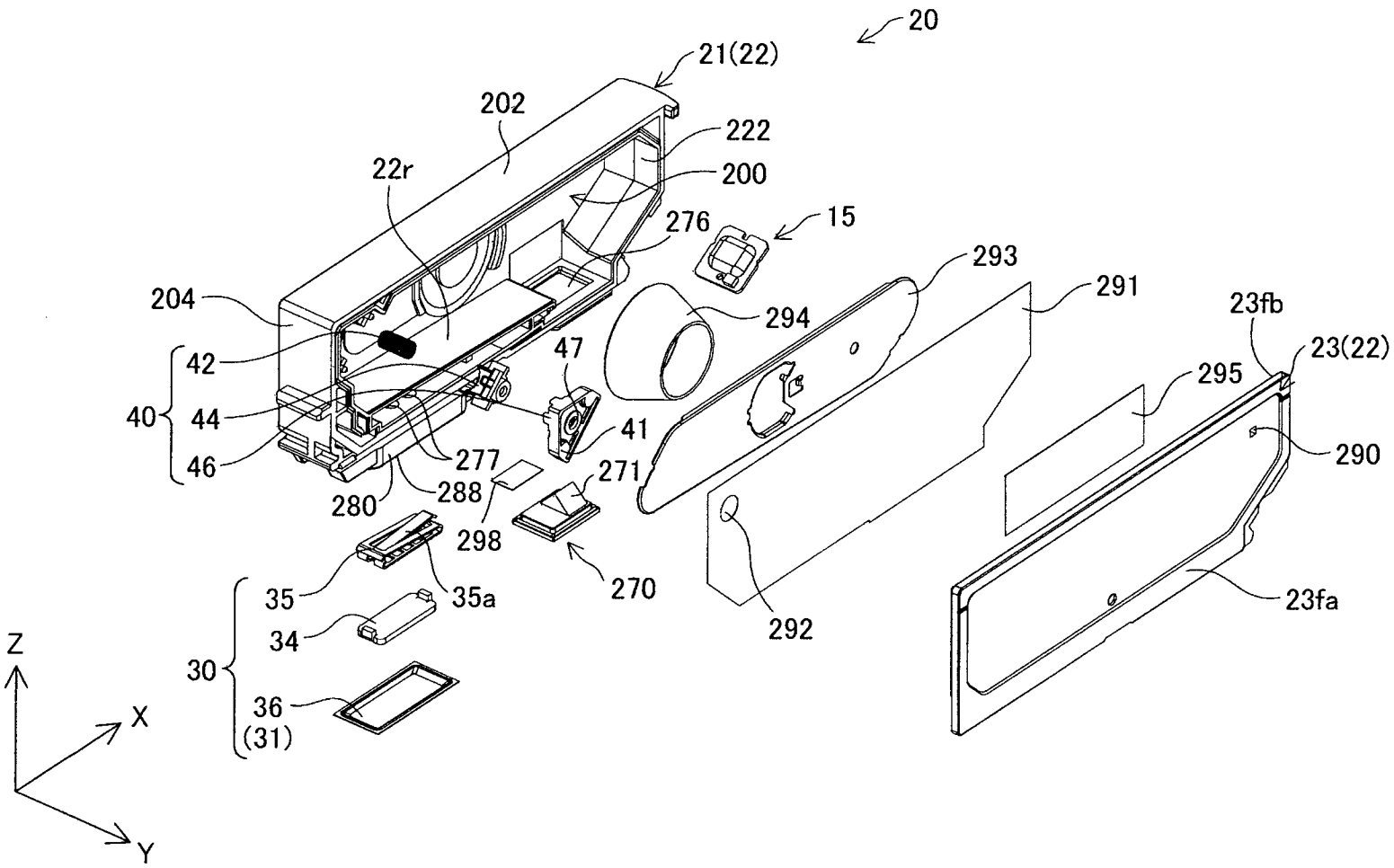
FIG. 15 is a first exploded perspective diagram of a cartridge.
Figure 16:
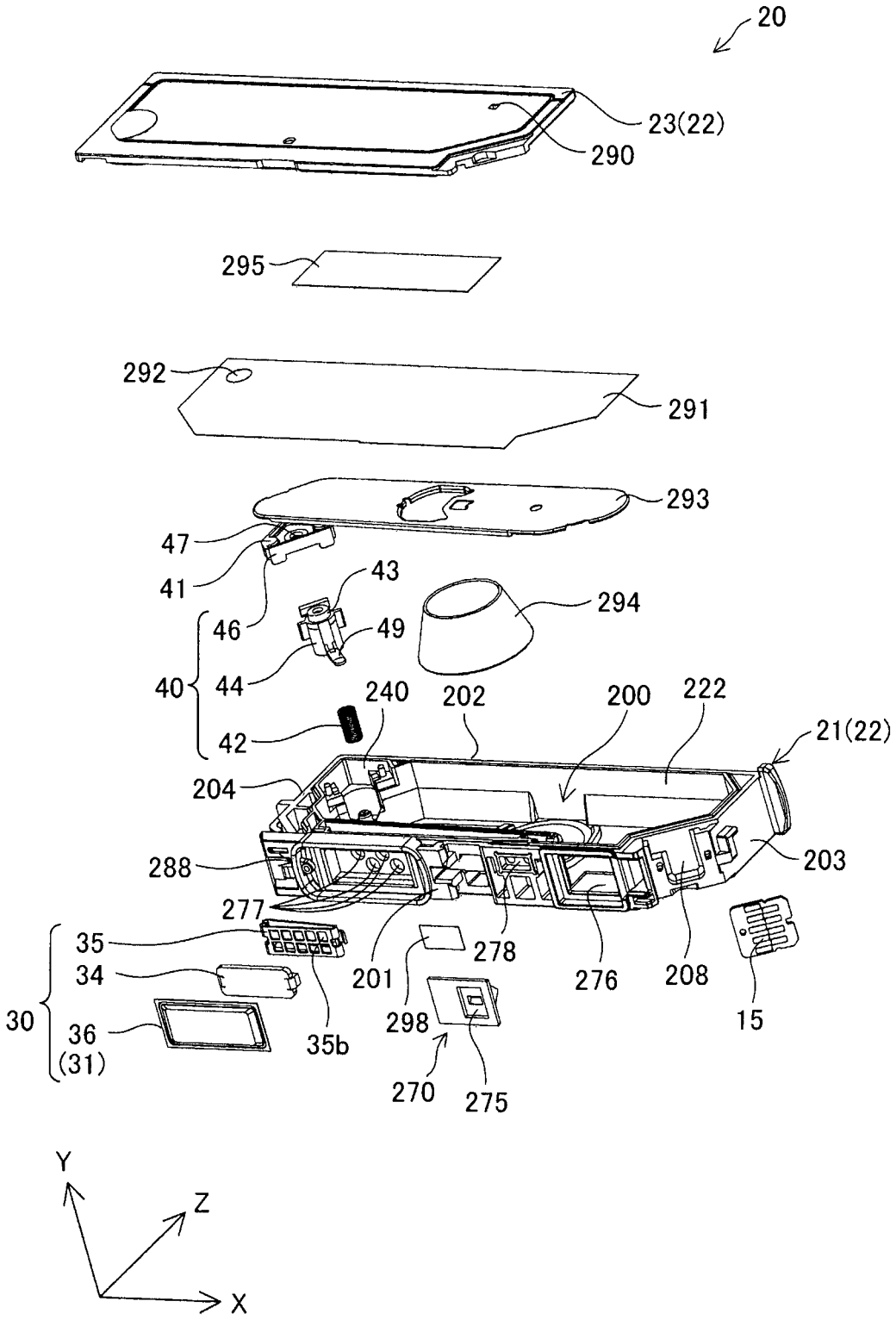
FIG. 16 is a second exploded perspective diagram of a cartridge.
Figure 17:
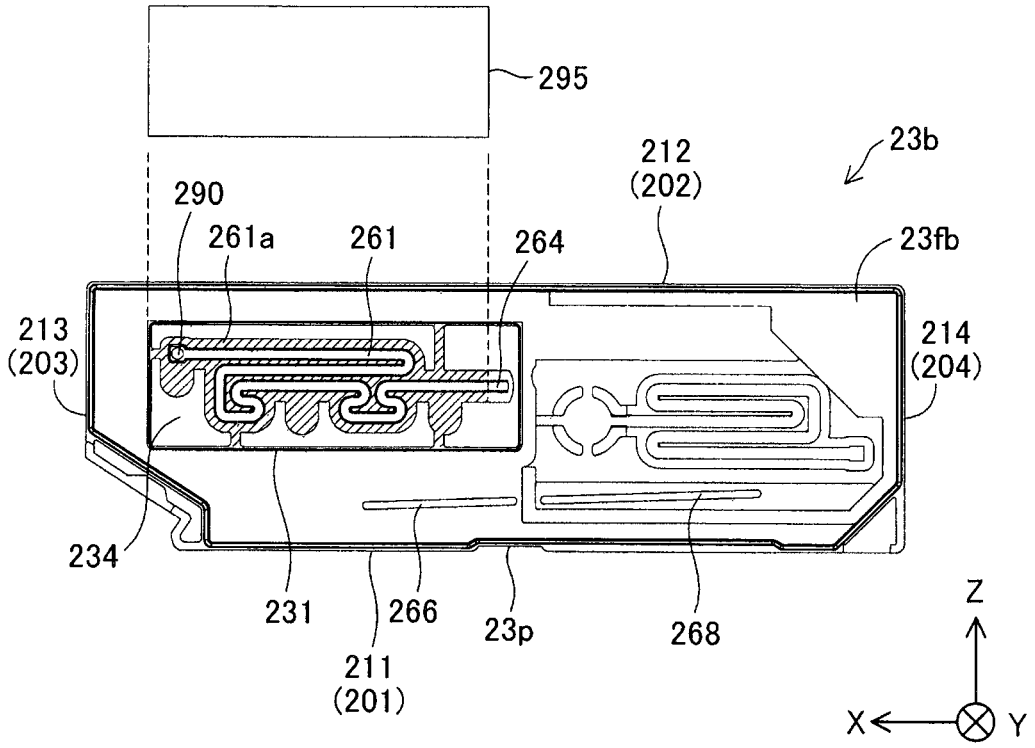
FIG. 17 is a diagram illustrating an opposite surface of a lid member and a second sheet member.
Figure 18:
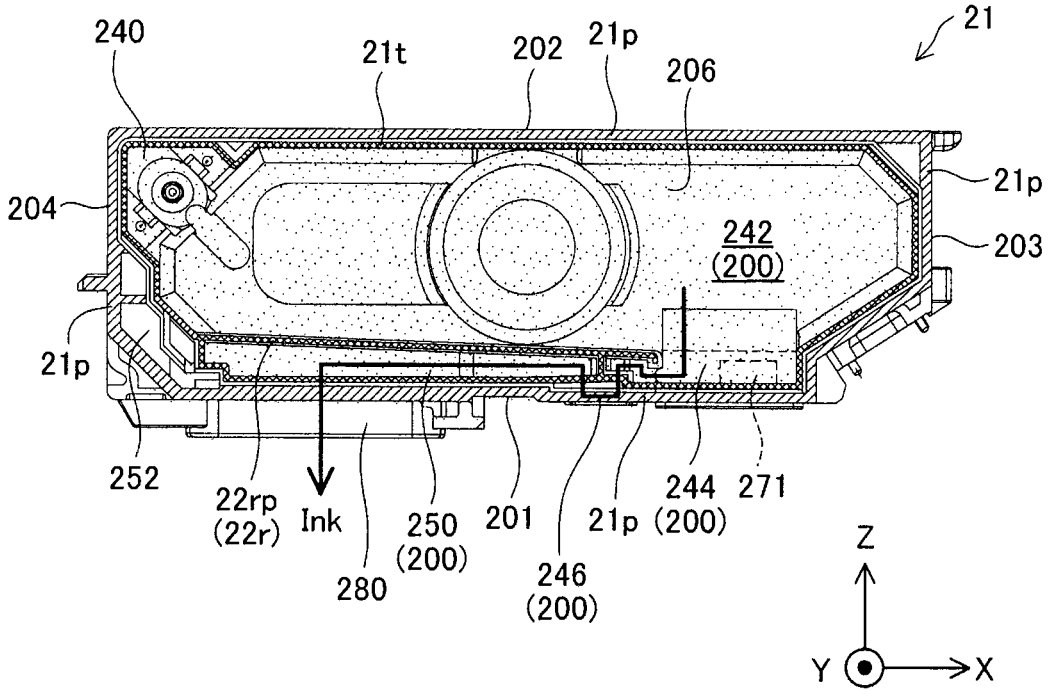
FIG. 18 is a diagram illustrating a container main body member.

FIG. 15 is a first exploded perspective diagram of the cartridge 20. FIG. 16 is a second exploded perspective diagram of the cartridge 20. FIG. 17 is a diagram illustrating the opposite surface 23*fb* of the lid member 23 and the second sheet member 295. FIG. 18 is a diagram illustrating the container main body member 21. In FIG. 18, the state of distributing ink in the printing material containing chamber 200 to the outside through the printing material supply port 280 is illustrated by an arrow. In FIG. 18, a front surface 271 of the prism 275 is illustrated by a dotted line.

As shown in FIG. 15 and FIG. 16, the cartridge 20 is provided with the container main body member 21, the lid member 23, and the first sheet member 291. The container main body member 21 has a substantially cuboidal shape. The container main body member 21 has a recessed shape having an opening 222 in a side wall (a wall on the +Y axial direction side). The first sheet member 291 adheres or thermally adheres to the container main body member 21, and defines the printing material containing chamber 200 together with the container main body member 21. The first sheet member 291 has flexibility. That is, a part of the outer circumferential wall of the printing material containing chamber 200 is formed by the first sheet member 291. A through hole 292 is formed in the first sheet member 291 so as to connect the air chamber 241 and the air introduction port 47.

The lid member 23 is attached to the container main body member 21 so as to cover the first sheet member 291. The container main body member 21 and the lid member 23 are made of synthetic resin such as polypropylene or the like. The first sheet member 291 is made of synthetic resin such as a material including nylon and polypropylene or the like. The plate-shaped lid member 23 has the opposite surface 23*fb* which is opposed to the first sheet member 291, and a front surface 23*fa* which is a surface on the opposite side of the opposite surface 23*fb*. The opposite surface 23*fb* is the inner surface of the cartridge 20, and the front surface 23*fa* is the outer surface of the cartridge 20.

The pressure receiving plate 293 is made of synthetic resin such as polypropylene or the like, or metal such as stainless steel or the like. The pressure receiving plate 293 is arranged to be opposed to the first sheet member 291. The coil spring 294 is arranged in the main chamber 242 of the printing material containing chamber 200. The coil spring 294 abuts against the pressure receiving plate 293, and a surface (opposite surface) of the container main body member 21 which is opposed to the pressure receiving plate 293. The pressure receiving plate 293 moves inside the printing material containing chamber 200 as ink in the printing material containing chamber 200 is consumed. The movement direction of the pressure receiving plate 293 is the Y axial direction (the direction perpendicular to the opposite surface 23*fb* and the front surface 23*fa*).

As shown in FIG. 15, the valve mechanism 40 is provided with the spring member 42, the lever valve 44, and the cover valve 46. The cover valve 46 is accommodated in a corner section 240 (FIG. 18) of the container main body member 21 in which the second surface 202 and the fourth surface 204 intersect, and is attached to the container main body member 21. The cover valve 46 is made of synthetic resin such as polypropylene or the like. As shown in FIG. 15 and FIG. 16, the cover valve 46 has a recessed shape, and the first sheet member 291 is hermetically attached to an end surface 41 in which an opening is formed. The recessed portion of the cover valve 46 is coupled with the through hole 292 of the first sheet member 291. The air introduction port 47 is formed in the bottom portion of the recessed portion of the cover valve 46 to penetrate to the back side of the cover valve 46.

The lever valve 44 is pressed onto the cover valve 46 by the spring member 42 so as to close the air introduction port 47. The lever valve 44 is provided with the lever section 49 (FIG. 16) which abuts by displacement of the pressure receiving plate 293. The lever valve 44 may be formed of synthetic resin such as polypropylene or the like. Further, the lever valve 44 may be formed by two-color molding using an elastic member such as elastomer or the like and synthetic resin such as polypropylene or the like.

The printing material supply port 280 is in communication with the printing material containing chamber 200. As shown in FIG. 16, the printing material containing chamber 200 is in communication with the printing material supply port 280 via a printing material communication hole 277. As shown in FIG. 15 and FIG. 16, the printing material supply port 280 has a member for supply 30 in the inside thereof. The member for supply 30 has a plate spring 35, a foam (porous member) 34, and a sheet member (filter member) 36. The sheet member 36, and the foam 34, and the plate spring 35 are arranged in this order from a side close to the opening end 288 of the printing material supply port 280. The foam 34 and the sheet member 36 are made of synthetic resin such as polyethylene terephthalate or the like, for example. The plate spring 35 is made of metal such as stainless steel or the like, for example. In the mounting state, the sheet member 36 contacts the printing material supply pipe 640 (FIG. 2), and distributes ink to the printer 50 side. That is, the sheet member 36 forms the printing material exit 31. The plate spring 35 presses the foam 34 toward the sheet member 36. The plate spring 35 has a distribution hole 35*b* for distributing ink.

As shown in FIG. 16, an opening section 278 is formed in the first surface 201 to penetrate the first surface 201. The connecting path 246 is formed by attaching the sheet member 298 to the first surface 201 so as to cover the opening section 278.

As shown in FIG. 17, an outer periphery portion 23*p* of the lid member 23 is attached by adhesion or thermal adhesion to a container side outer periphery portion 21*p* (FIG. 18) of an end portion on the opening side (+Y axial direction side) of the container main body member 21. The container side outer periphery portion 21*p* includes single hatching in the drawing. Also, as shown in FIG. 18, the first sheet member 291 is hermetically attached to inside end portions 21*t* or 22*rp* which are located inside with respect to the container side outer periphery portion 21*p* among the end portion (end surface) on the opening side (+Y axial direction side) of the container main body member 21. The flow path chamber 252 is formed outside the region in which the first sheet member 291 is attached among the container main body member 21. Here, the inside end portions 21*t* or 22*rp* include cross hatching for easy understanding. Also, the region marked with dots in FIG. 18 is the printing material containing chamber 200.

As shown in FIG. 15 and FIG. 18, the printing material containing chamber 200 has a partition wall 22*r* which extends from the opposite wall 206 (sixth surface 206), which is opposed to the opening 222, toward the opening 222. The partition wall 22*r* separates the main chamber 242 and the buffer chamber 250. In FIG. 12 to FIG. 14, the detection chamber 244 is illustrated as a chamber independent from the main chamber 242. As shown in FIG. 18, however, the detection chamber 244 is actually configured as a part of the main chamber 242. The printing material containing chamber 200 is partitioned into the main chamber 242 of a large volume and the buffer chamber 250 of a small volume by the partition wall 22*r*. In the present embodiment, the volume of the main chamber 242 in a state where ink is filled (initial state) is approximately ten times larger than the volume of the buffer chamber 250. As shown in the arrow of FIG. 18, the ink in the main chamber 242 flows into the printing material supply port 280 through the detection chamber 244, the connecting path 246, and the buffer chamber 250. In FIG. 18, a dotted line is put to the boundary portion between the main chamber 242 and the detection chamber 244.

Here, the relationship between the volume of the main chamber 242 and the volume of the buffer chamber 250 will be explained. In the present embodiment, it is not configured such that printing is immediately stopped after the absence of ink is determined by optical detection using the prism 275 inside the detection chamber 244. At the time when the absence of ink is determined by optical detection, there is no ink only in the main chamber 242 (including the detection chamber 244), but there is still ink in the buffer chamber 250. Therefore, at this time, the printer 50 conducts a display or the like to encourage the user to prepare a new cartridge 20. Then, after that, the printing can be continued using the ink in the buffer chamber 250. The timing for finally stopping the printing is determined based on management information obtained by managing the consumption amount of ink in the buffer chamber 250 with the control section 510 of the printer 50 based on predetermined data. This management of the consumption amount of ink based on the management information is conducted based on data regarding the consumption amount of ink set in advance for each of various operations of the printer 50, and is not conducted by measuring the actual consumption amount of ink. Actual detection of the presence or absence of ink using the prism 275 is more accurate than management of the consumption amount of ink based on data. Therefore, it can be said that the overall management accuracy of the amount of ink becomes high by making the volume of the buffer chamber 250, in which the consumption amount of ink is managed based on data, as small as possible compared to the volume of the main chamber 242, in which the consumption state of ink is managed by actually detecting the presence or absence of ink. If the overall management accuracy of the amount of ink becomes high, the amount of ink which remains in the cartridge 20 at the time of finally stopping the printing can be made small. Accordingly, the volume of the main chamber 242 is preferably three times or more, or more preferably five times or more with respect to the volume of the buffer chamber 250. On the other hand, if the volume of the buffer chamber 250 is made too small with respect to the volume of the main chamber 242, a period until the printing is finally stopped cannot be sufficiently obtained after there is no more ink in the main chamber 242 (including the detection chamber 244). Consequently, the volume of the main chamber 242 is preferably set to be twenty times or less, or more preferably fifteen times or less with respect to the volume of the buffer chamber 250. In sum, the volume of the main chamber 242 is set within the range of three times to twenty times with respect to the volume of the buffer chamber 250, more preferably within the range of five times to fifteen times with respect to the volume of the buffer chamber 250.

As shown in FIG. 17, a groove section 261, the communication section 264, and protruding sections 266, 268 are formed on the opposite surface 23*fb* of the lid member 23. The groove section 261, the communication section 264, and the protruding sections 266, 268 are formed inside with respect to the outer periphery portion 23*p*. As explained above, the outer periphery portion 23*p* is an attachment portion to the container main body member 21. The lid member 23 also has a portion of thickness larger than that of the other portion. The other portion is referred to as a "small-thickness portion", and the portion of large thickness is referred to as a "large-thickness portion". The large-thickness portion protrudes toward the first sheet member 291 with respect to the small-thickness portion. The groove section 261, the ventilation port 290, and the communication section 264 are formed in the large-thickness portion.

The groove section 261 has a meandering shape. The groove section 261 has a shape bent at 180° in at least one position. An end portion on the upstream side of the groove section 261 is connected with the ventilation port 290. An end portion on the downstream side of the groove section 261 is connected with the communication section 264. The communication section 264 is formed on the opposite surface 23*fb* as a recessed portion. As shown in FIG. 17, the second sheet member 295 is attached to the opposite surface 23*fb* so as to cover the ventilation port 290 and the groove section 261. The second sheet member 295 is attached by adhesion or thermal adhesion to a bank 261*a* in the surroundings of the ventilation port 290 and the groove section 261 among the opposite surface 23*fb*. The bank 261*a* is marked with diagonal lines in FIG. 17. In this manner, the inner communication path 262 is constructed of the groove section 261 and the second sheet member 295. The inner communication path 262 is a meandering path in which at least one position is bent at 180° corresponding to the shape of the groove section 261.

The protruding sections 266, 268 extend linearly, respectively. Also, the protruding sections 266, 268 are positioned on the same straight line. The protruding sections 266, 268 protrude from the opposite surface 23*fb* toward the inside of the cartridge 20, that is, toward the printing material containing chamber 200. The protruding sections 266, 268 are opposed to the end portion 22*rp* (FIG. 18) of the partition wall 22*r* which separates the main chamber 242 and the buffer chamber 250.

Figure 19:
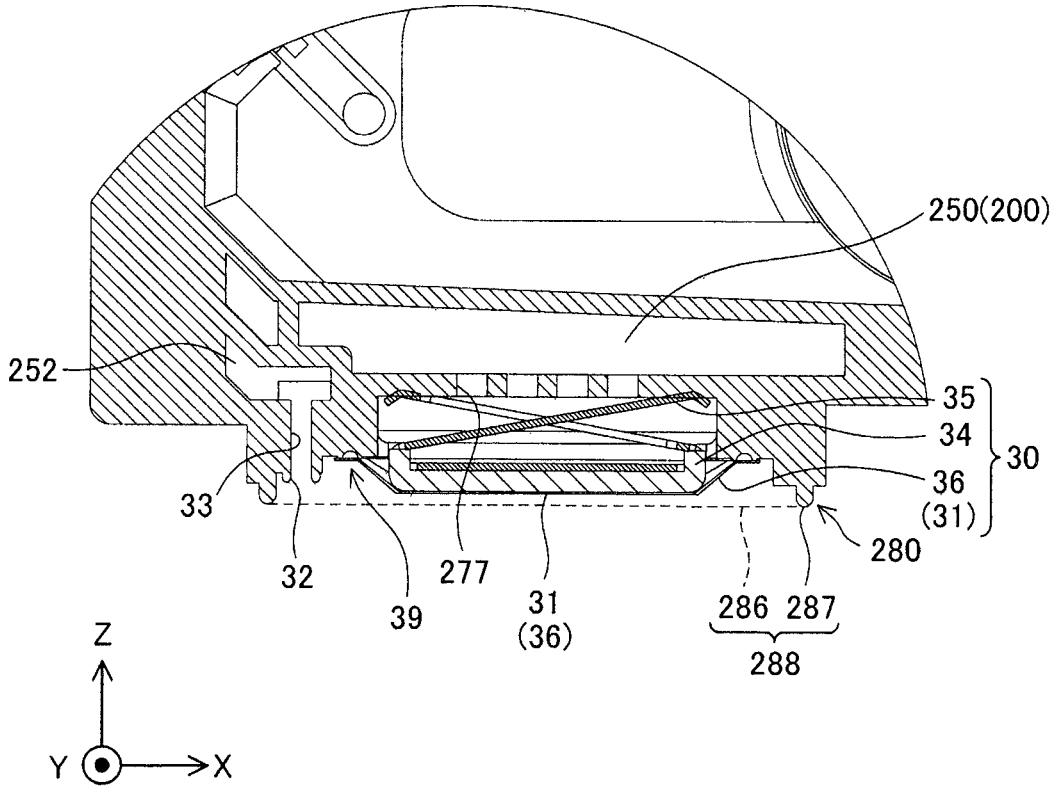
FIG. 19 is a partial cross-sectional diagram cut in F10-F10 of FIG. 10.

FIG. 19 is a partial cross-sectional diagram cut in F10-F10 of FIG. 10. As shown in FIG. 19, the printing material supply port 280 has the inner path 33. The inner path 33 is a flow path which is located on one end side of the second communication path 310 and includes the communication port 32. The inner path 33 is formed by penetrating a member which defines the printing material supply port 280. The inner path 33 is connected with the flow path chamber 252. The inner path 33 extends along the Z axial direction.

A-6. Ink Injection Kit (Ink Injection Device)

Figure 20:
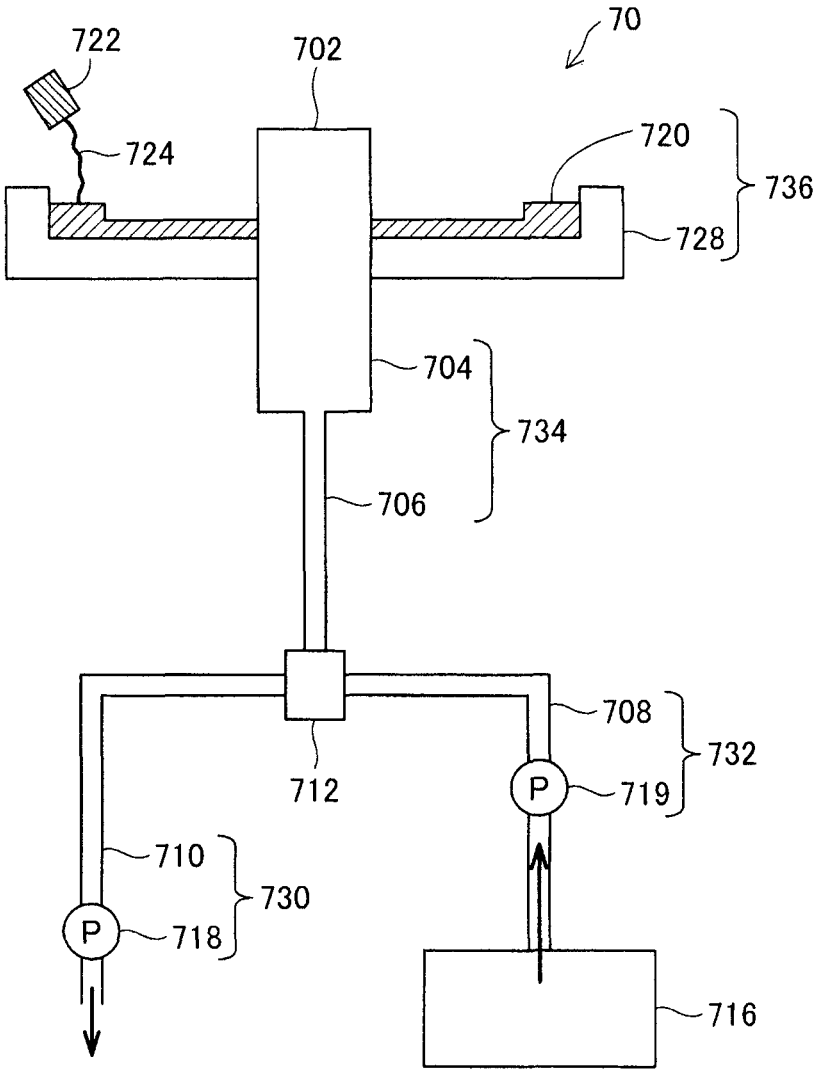
FIG. 20 is a diagram for explaining an injection kit or an injection device.
Figure 21:
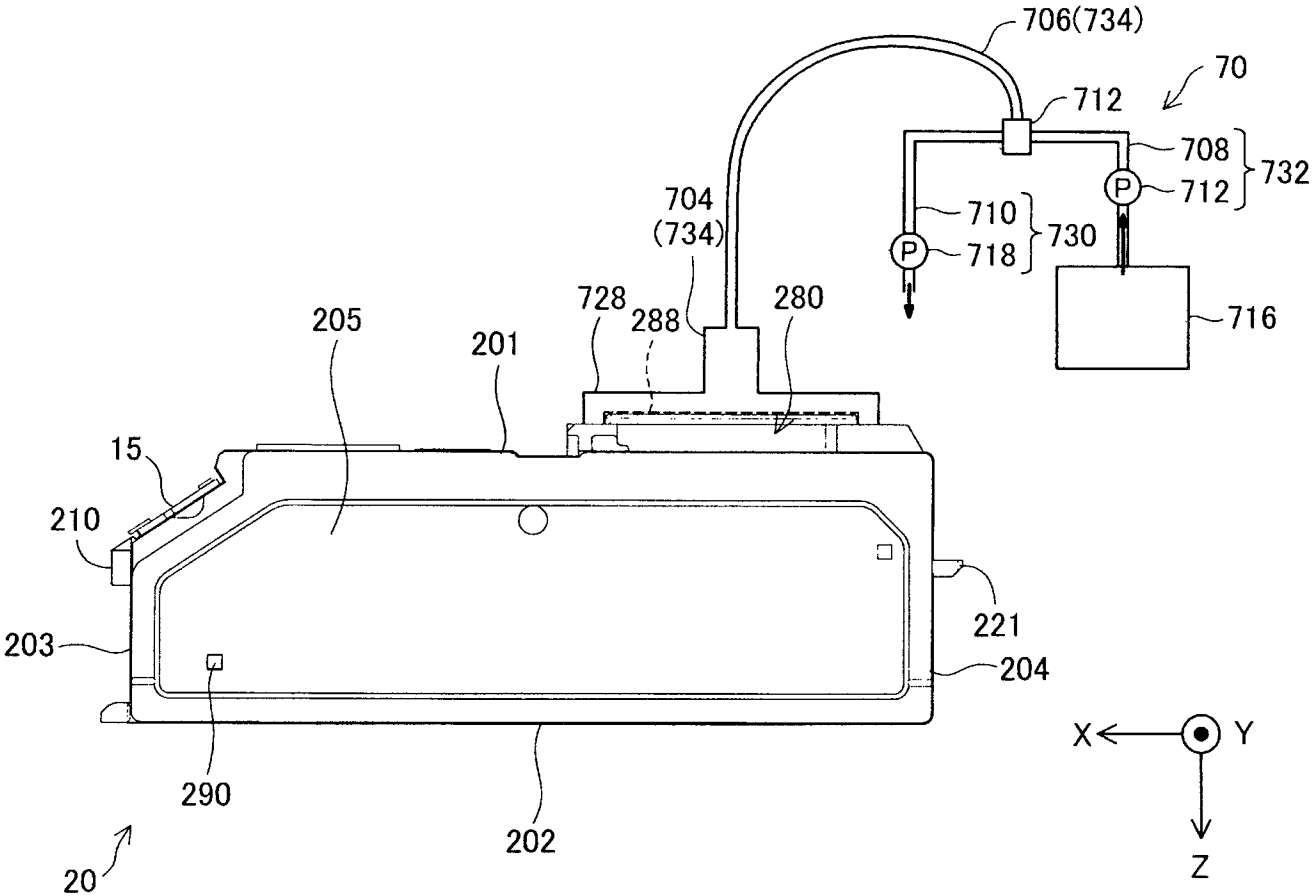
FIG. 21 is a diagram in which an injection kit or an injection device is attached to a cartridge.
Figure 22:
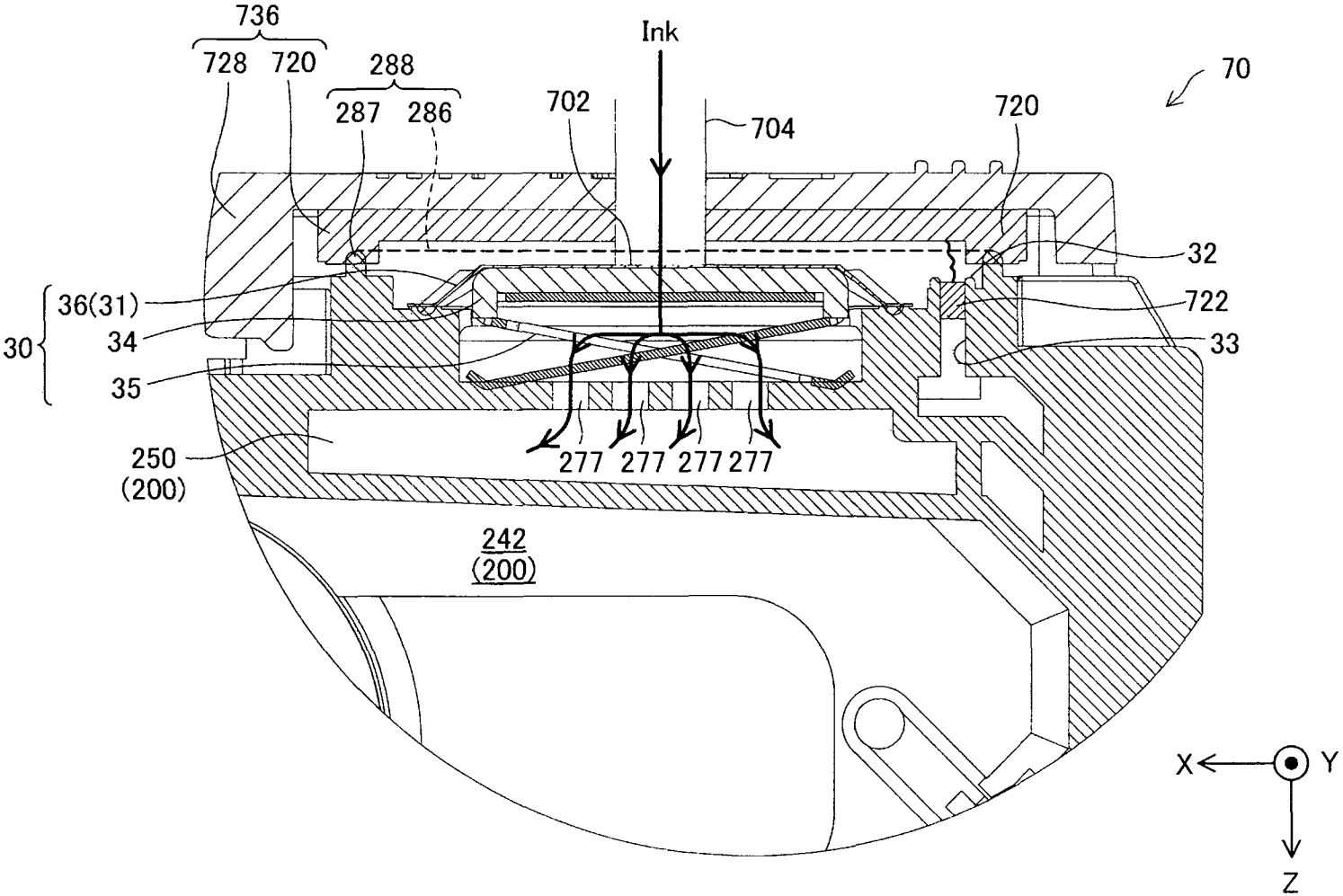
FIG. 22 is a partial cross-sectional diagram of a state in which an injection kit or an injection device is set at a cartridge.

FIG. 20 is a diagram for explaining an injection kit (injection device) 70. FIG. 21 is a diagram in which the injection kit (injection device) 70 is attached to the cartridge 20. FIG. 22 is a partial cross-sectional diagram of a state in which the injection kit (injection device) 70 is set at the cartridge 20.

As shown in FIG. 20, the injection kit (injection device) 70 is used for injecting ink into the cartridge 20. The injection kit (injection device) 70 is provided with a plug unit 722, an injection unit 734, a sealing unit 736, a discharging unit 730, a pressurizing unit 732, and a switching unit 712. In the present embodiment, as shown in FIG. 21, when injecting ink, the cartridge 20 is placed into a state in which the opening end 288 is located above the printing material containing chamber 200 (also referred to as a "receiving state"). The receiving state is a state of being turned upside down with respect to the mounting state. Also, the receiving state is a state in which the opening 286 of the opening end 288 is directed in the gravity upward direction (+Z axial direction).

The plug unit 722 is a unit for closing the inner path 33. The plug unit 722 is a member to be fitted into the inner path 33, for example. The plug unit 722 is made of an elastic member such as rubber, for example. As shown in FIG. 22, ink is prevented from flowing into the inner path 33 by causing the plug unit 722 to be fitted into the inner path 33. When ink is injected, the plug unit 722 is connected with the sealing unit 736 by a linear connecting member 724 such that the plug unit 722 is integral with the injection kit (injection device) 70. Incidentally, the connecting member 724 may be omitted, and the plug unit 722 does not need to be connected with other elements of the injection kit (injection device) 70.

As shown in FIG. 20, the injection unit 734 is a unit for injecting ink into the printing material containing chamber 200 through the printing material supply port 280. The injection unit 734 has a flow path for allowing ink to be distributed which is formed in the inside thereof. The injection unit 734 is connected with a printing material supply source 716 such as an ink tank or the like. The printing material supply source 716 may be one of the constituent elements of the injection kit (injection device) 70. The injection unit 734 is provided with an injection instrument main body 704 and a tube 706. The injection instrument main body 704 is made of synthetic resin such as polypropylene or the like, for example. The tube 706 has flexibility. The tube 706 is connected with the injection instrument main body 704. In the present embodiment, the injection unit 734 is connected with the printing material supply source 716 through the pressurizing unit 732. As shown in FIG. 22, a tip end section 702 of the injection instrument main body 704 abuts against the printing material exit 31 of the printing material supply port 280, and ink is injected into the cartridge 20 through the tip end section 702.

As shown in FIG. 20, the sealing unit 736 is a unit for sealing the opening end 288 of the printing material supply port 280. "Sealing the opening end 288" is a concept which includes a state in which a flow path used for injecting ink into the printing material containing chamber 200 is secured, and it is not limited to a state in which the outside and the inside of the printing material supply port 280 are not in communication with each other through the opening end 288. The flow path used for injecting ink is a flow path necessary for each process to be carried out in the ink injection method described below, and for example, a flow path for injecting ink or a flow path for discharging air.

The sealing unit 736 has a seal member 720 and a containing member 728. As shown in FIG. 22, the sealing unit 736 tightly adheres to the partition end section 287 without any gap so as to cover the opening 286. As a result of this, ink is prevented from leaking to the outside through the opening end 288. The seal member 720 is made of an elastic member such as rubber, for example. The containing member 728 is a member for containing the seal member 720. The containing member 728 has a recessed shape. The containing member 728 is made of synthetic resin such as polypropylene, for example. The outer shapes of the seal member 720 and the containing member 728 correspond to the outer shape of the opening end 288. In the present embodiment, the outer shapes of the seal member 720 and the containing member 728 are substantially elliptical.

As shown in FIG. 20 and FIG. 22, the injection unit 734 (in more detail, the injection instrument main body 704) is arranged to penetrate the seal member 720 and the containing member 728. That is, the sealing unit 736 has a flow path formed to be able to inject ink from the outside to the inside of the cartridge 20 through the printing material supply port 280. Therefore, it can be said that the injection unit 734 is one of the constituent elements of the sealing unit 736. Also, the flow path of the injection unit 734 doubles as a flow path for discharging air in the printing material containing chamber 200 as described below.

As shown in FIG. 20, the discharging unit 730 is a unit for aspirating fluid in the printing material containing chamber 200. More specifically, the discharging unit 730 is a unit for discharging air in the printing material containing chamber 200 to the outside through the printing material supply port 280. The discharging unit 730 is provided with a discharging line 710 and a discharging pump 718. The discharging line 710 is connected with the injection unit 734. Air in the cartridge 20 can be discharged from the tip end section 702 to the outside by driving the discharging pump 718.

The pressurizing unit 732 is a unit for pressurizing and injecting ink into the printing material containing chamber 200 through the printing material supply port 280. The pressurizing unit 732 is provided with a pressurizing line 708 and a pressurizing pump 719. The pressurizing line 708 is connected with the injection unit 734. Ink pressurized to be equal to or more than the atmospheric pressure can be injected into the cartridge 20 from the tip end section 702 by driving the pressurizing pump 719.

The switching unit 712 is a unit for switching injection of ink into the printing material containing chamber 200 by the injection unit 734 and discharge of air from the printing material containing chamber 200 by the discharging unit 730. The switching unit 712 is arranged in a position in which the injection unit 734, the discharging line 710, and the pressurizing line 708 are connected with each other, for example. As for the switching unit 712, a switching valve or the like can be used, for example. The connection between the injection unit 734 and the discharging line 710 and the connection between the injection unit and the pressurizing line 708 are switched by the switching unit 712.

A-7. Ink Injection Method

Figure 23:
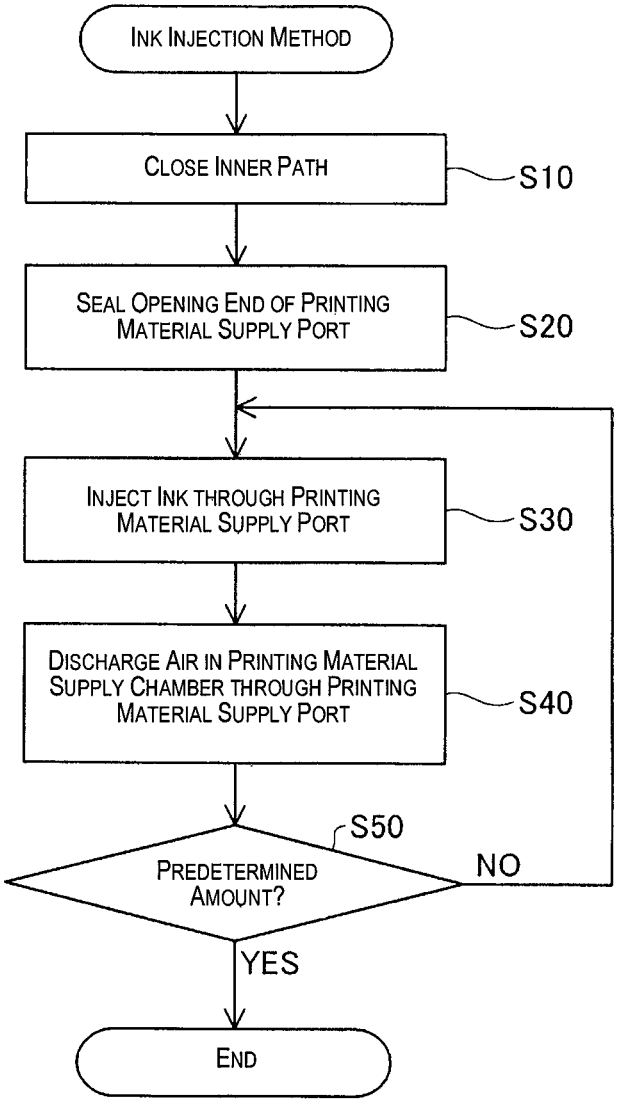
FIG. 23 is a diagram for explaining an ink injection flow.

FIG. 23 is a diagram for explaining an ink injection flow. The ink injection flow can be carried out, for example, to inject ink again (re-inject) into the cartridge 20 after ink in the cartridge 20 is consumed and there is no more ink. The ink injection flow can also be carried out, for example, to inject (initially inject) ink into the cartridge 20 during initial manufacturing of the cartridge 20. In the present embodiment, the ink injection into the cartridge 20 is carried out using the injection kit (injection device) 70. However, the injection kit (injection device) 70 does not need to be used for carrying out the ink injection into the cartridge 20, and an optional instrument can be employed as long as it is an instrument which can inject ink into the cartridge 20. Also, the ink injection method described below can be carried out while keeping the cartridge 20 in the receiving state (FIG. 21).

First, the inner path 33 of the cartridge 20 is closed (step S10). Specifically, the inner path 33 is closed by inserting the plug unit 722 into the inner path 33 (step S10). However, the inner path 33 may be closed by sealing the communication port 32 with a sheet member, for example.

After step S10, the opening end 288 of the printing material supply port 280 is sealed (step S20). Specifically, the seal member 720 of the sealing unit 736 is tightly attached to the opening end 288 without any gap. After step S20, ink is injected into the printing material containing chamber 200 through the printing material supply port 280 (step S30). Specifically, ink is distributed from the printing material supply source 716 to the pressurizing line 708 and the injection unit 734 in this order in a state where the tip end section 702 of the injection instrument main body 704 abuts against the printing material exit 31 (FIG. 20, FIG. 22). In step S30, by the switching unit 712, the tube 706 and the pressurizing line 708 are placed into a communication state, and the tube 706 and the discharging line 710 are placed into a non-communication state. Also, in step S30, ink pressurized to predetermined pressure which is equal to or more than the atmospheric pressure is injected into the printing material containing chamber 200 through the tip end section 702 by driving the pressurizing pump 719.

After step S30, fluid (mainly, air) in the printing material containing chamber 200 is discharged to the outside through the printing material supply port 280 (step S40). Specifically, by the switching unit 712, the tube 706 and the discharging line 710 are placed into a communication state, and the tube 706 and the pressurizing line 708 are placed into a non-communication state. The inside of the printing material containing chamber 200 is aspirated through the tip end section 702 by driving the discharging pump 718. In this manner, air in the printing material containing chamber 200 is discharged to the outside.

Next, in a case where a predetermined amount of ink is contained in the printing material containing chamber 200 (step S50: YES), the ink injection is finished. On the other hand, in a case where the predetermined amount of ink is not injected (step S50: NO), the ink injection (step S30) and the air discharge (step S40) are conducted again. The predetermined amount refers to an amount which allows the front surface 271 (FIG. 18) of the prism 275 to be immersed in the ink at least in the mounting state of the cartridge 20. It is possible to determine whether the predetermined amount of ink is injected or not by measuring the amount of ink in the printing material supply source 716, for example. Here, the step of discharging air (step S40) does not need to be conducted after the step of injecting ink (step S30) for the second time. The steps other than step S10 and step S30 are not essential, and can be omitted.

A-8. Effects

According to the first embodiment as described above, ink is injected into the printing material containing chamber 200 through the printing material supply port 280 after closing the inner path 33 (step S10 and step S30 of FIG. 23). It is thus possible to prevent ink from leaking to the outside through the second communication path (opening path) 310 including the inner path 33.

Also, in the first embodiment, the opening end 288 of the printing material supply port 280 is sealed before injecting ink into the printing material containing chamber 200 (step S20 of FIG. 23). It is thus possible to prevent ink from leaking to the outside through the opening end 288 of the printing material supply port 280 when ink is injected into the printing material containing chamber 200 through the printing material supply port 280.

Also, in the first embodiment, ink is injected into the printing material containing chamber 200 until at least the front surface 271 of the prism 275 is immersed in the ink in the mounting state (step S50 of FIG. 23). That is, in the mounting state, the liquid level of the ink in the printing material containing chamber 200 is located above the prism 275. Consequently, the presence or absence of ink can be detected using the prism 275 in the cartridge 20 after injecting ink.

Also, in the first embodiment, after the step of injecting ink, air in the printing material containing chamber 200 is discharged to the outside by aspirating the inside of the printing material containing chamber 200 in the receiving state of the cartridge 20 (step S40 of FIG. 23). Consequently, it is possible to discharge air existing in the printing material containing chamber 200 or in an upstream side portion (a portion on the printing material containing chamber 200 side) with respect to the printing material exit 31 among the printing material supply port 280. It is thus possible to reduce the amount of air existing in the printing material containing chamber 200 or in the upstream side portion. By reducing the amount of air existing in the printing material containing chamber 200 or in the upstream side portion, it is possible to prevent trouble of the printer 50 (for example, damage to the head 540 or deterioration of printed image quality) from occurring due to so-called air shot of the head 540.

Also, in the first embodiment, each step for injecting ink can be implemented easily with the injection kit (injection device) 70. For example, the injection kit (injection device) 70 is provided with the plug unit 722, thereby making it possible to easily close the inner path 33 (FIG. 20, FIG. 22). Also, for example, the injection kit (injection device) 70 is provided with the sealing unit 736, thereby making it possible to easily seal the opening end 288 (FIG. 20, FIG. 22). Also, the injection kit (injection device) 70 is provided with the discharging unit 730, thereby making it possible to easily discharge air existing in the printing material containing chamber 200. Also, the injection kit (injection device) 70 is provided with the switching unit 712, thereby making it possible to repeatedly conduct injection of ink and discharge of air. Also, the injection kit (injection device) 70 is provided with the pressurizing unit 732, thereby making it possible to inject the predetermined amount of ink into the printing material containing chamber 200 for a short period of time.

B. Second Embodiment

B-1. Configuration of Injection Kit (Injection Device)

Figure 24:
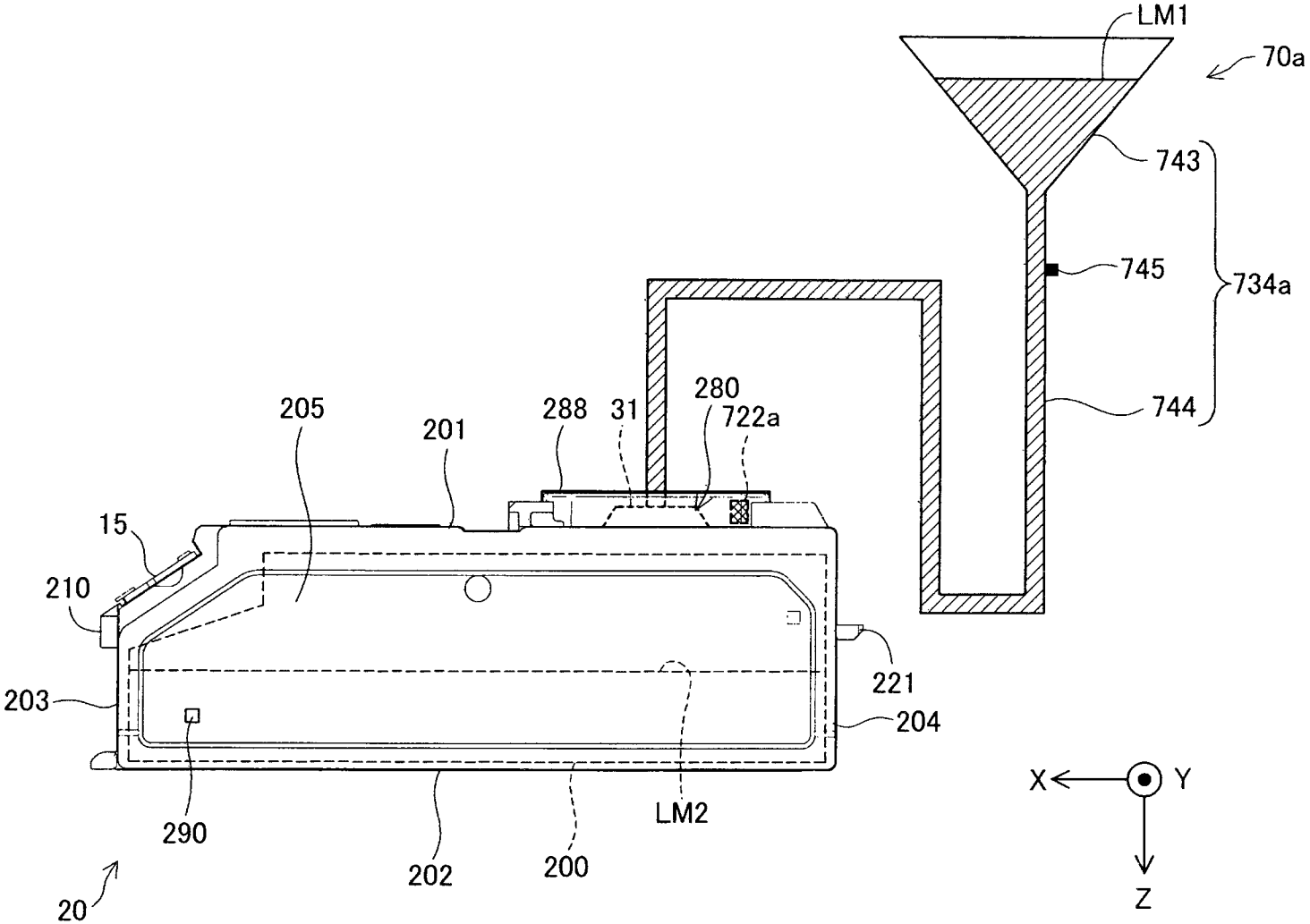
FIG. 24 is a diagram for explaining an injection kit or an injection device according to a second embodiment.

FIG. 24 is a diagram for explaining an injection kit (injection device) 70*a* according to a second embodiment. FIG. 24 illustrates a state immediately before starting ink injection into the cartridge 20 using the injection kit (injection device) 70*a* in which the injection kit (injection device) 70*a* has been set at the cartridge 20. In this embodiment, ink is injected into the cartridge 20 in the receiving state in which the opening end 288 of the cartridge 20 is located above the printing material containing chamber 200. Here, since the cartridge 20 of the second embodiment has a configuration similar to that of the cartridge 20 of the first embodiment, the explanation thereof will be omitted. The injection kit (injection device) 70*a* of the second embodiment injects ink into the printing material containing chamber 200 automatically by water head difference between the cartridge 20 and the injection kit (injection device) 70*a*.

The injection kit (injection device) 70*a* is provided with an injection unit 734*a*, a plug unit 722*a*, and an auxiliary unit 745. In the same manner as the first embodiment, the plug unit 722*a* is a unit for closing the inner path 33. The plug unit 722*a* is made of an elastic member such as rubber, for example.

The injection unit 734*a* is provided with a printing material reservoir section 743 and an injection line 744. The printing material reservoir section 743 reserves ink to be supplied to the cartridge 20. The injection line 744 is connected with the printing material reservoir section 743. A rigid pipe can be used as the injection line 744, for example. Ink is injected by causing an end portion of the injection line 744 to abut against the printing material exit 31 so as to inject ink into the printing material containing chamber. The auxiliary unit 745 is provided in the injection line 744. The auxiliary unit 745 is a mark attached to the outer surface of the injection line 744. As shown in FIG. 24, the auxiliary unit 745 is located on the upper side in the gravity direction (+Z axial direction) with respect to the opening end 288 in a state (injecting state) in which the injection kit (injection device) 70*a* is set at the cartridge 20 and injection is conducted. The user replenishes the printing material reservoir section 743 with ink, so that a liquid level LM1 of ink in the injection kit (injection device) 70*a* is not located below the auxiliary unit 745. Alternatively, the printing material reservoir section 743 may be automatically replenished with ink, so that the liquid level LM1 of ink in the injection kit (injection device) 70*a* is not located below the auxiliary unit 745. As a configuration for automatically replenishing with ink, for example, it may be possible to use a configuration which is provided with a sensor for detecting the liquid level LM1 of ink in the printing material reservoir section 743 and a mechanism for supplying ink from the printing material supply source connected with the printing material reservoir section 743 to the printing material reservoir section 743 in response to signals of the sensor. As a result of this, the liquid level LM1 of ink in the injection kit (injection device) 70*a* is always located on the upper side in the gravity direction with respect to a liquid level LM2 of ink in the printing material containing chamber 200 while ink is injected into the printing material containing chamber 200. Consequently, the injection kit (injection device) 70*a* can inject ink into the printing material containing chamber 200 automatically by water head difference.

B-2. Ink Injection Method

Figure 25:
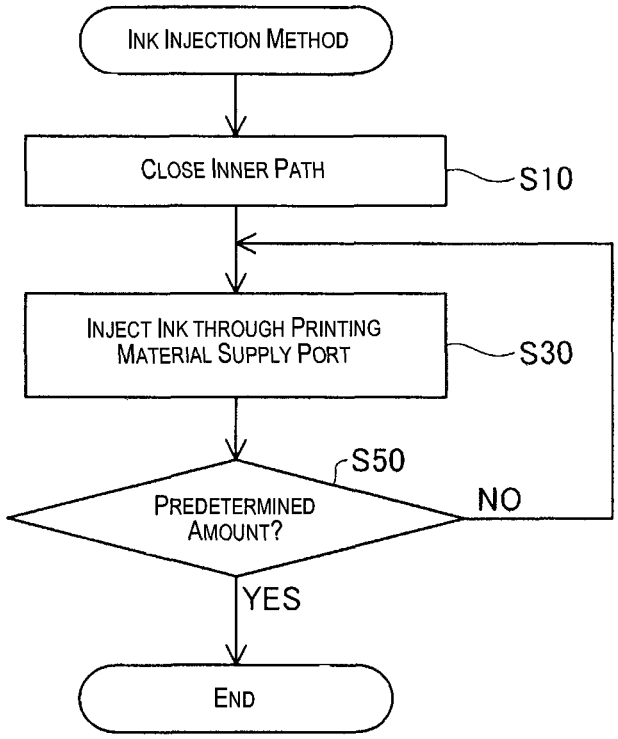
FIG. 25 is a diagram for explaining an ink injection flow according to a second embodiment.

FIG. 25 is a diagram for explaining an ink injection flow according to the second embodiment. In the same manner as the first embodiment, the ink injection flow can be carried out when ink is re-injected into the used cartridge 20 or when ink is injected into the cartridge 20 during initial manufacturing.

As shown in FIG. 25, in the ink injection method of the second embodiment, step S20 and step S40 are omitted from the ink injection method of the first embodiment. The other steps are similar to the first embodiment. That is, ink is injected into the printing material containing chamber 200 through the printing material supply port 280 after closing the inner path 33 with the plug unit 722*a* (step S10, step S30). Ink is injected into the printing material containing chamber 200 until a predetermined amount of ink is contained in the printing material containing chamber 200 (step S50).

B-3. Effects

According to the second embodiment as described above, ink is injected into the printing material containing chamber 200 through the printing material supply port 280 after closing the inner path 33 (step S10 of FIG. 25). It is thus possible to prevent ink from leaking to the outside through the second communication path (opening path) 310 including the inner path 33.

Also, in the second embodiment, ink is injected into the printing material containing chamber 200 until at least the front surface 271 of the prism 275 is immersed in the ink in the mounting state (step S50 of FIG. 25). Consequently, the presence or absence of ink can be detected using the prism 275 in the cartridge 20 after injecting ink.

Also, in the second embodiment, ink is injected into the printing material containing chamber 200 using the injection kit (injection device) 70*a* which can inject ink into the printing material containing chamber 200 by water head difference (FIG. 24). Consequently, by setting the injection kit (injection device) 70*a* at the cartridge 20, it is possible to automatically inject ink into the printing material containing chamber 200.

C. Third Embodiment

Figure 26:
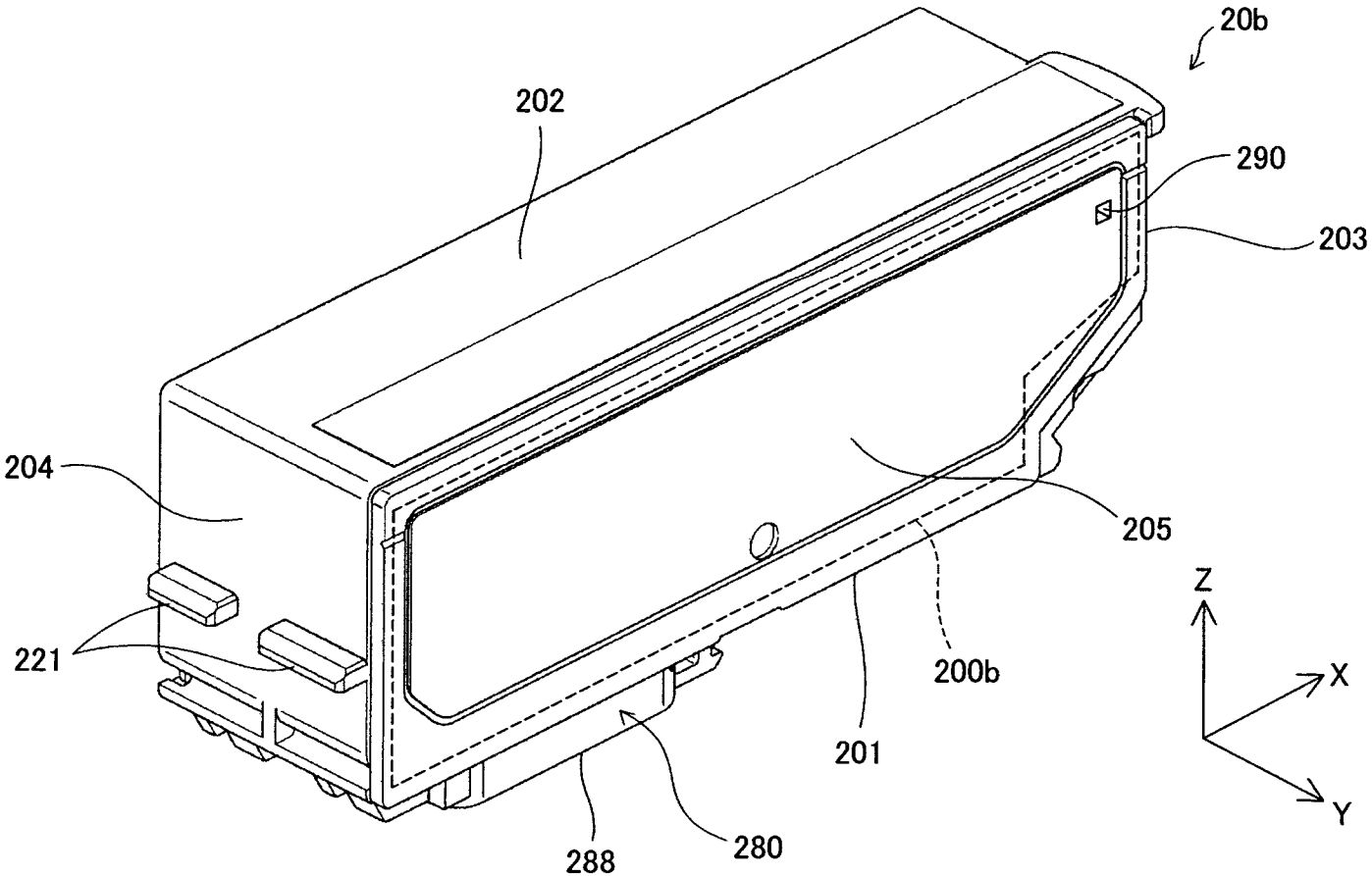
FIG. 26 is a perspective diagram illustrating a cartridge according to a third embodiment.
Figure 27:
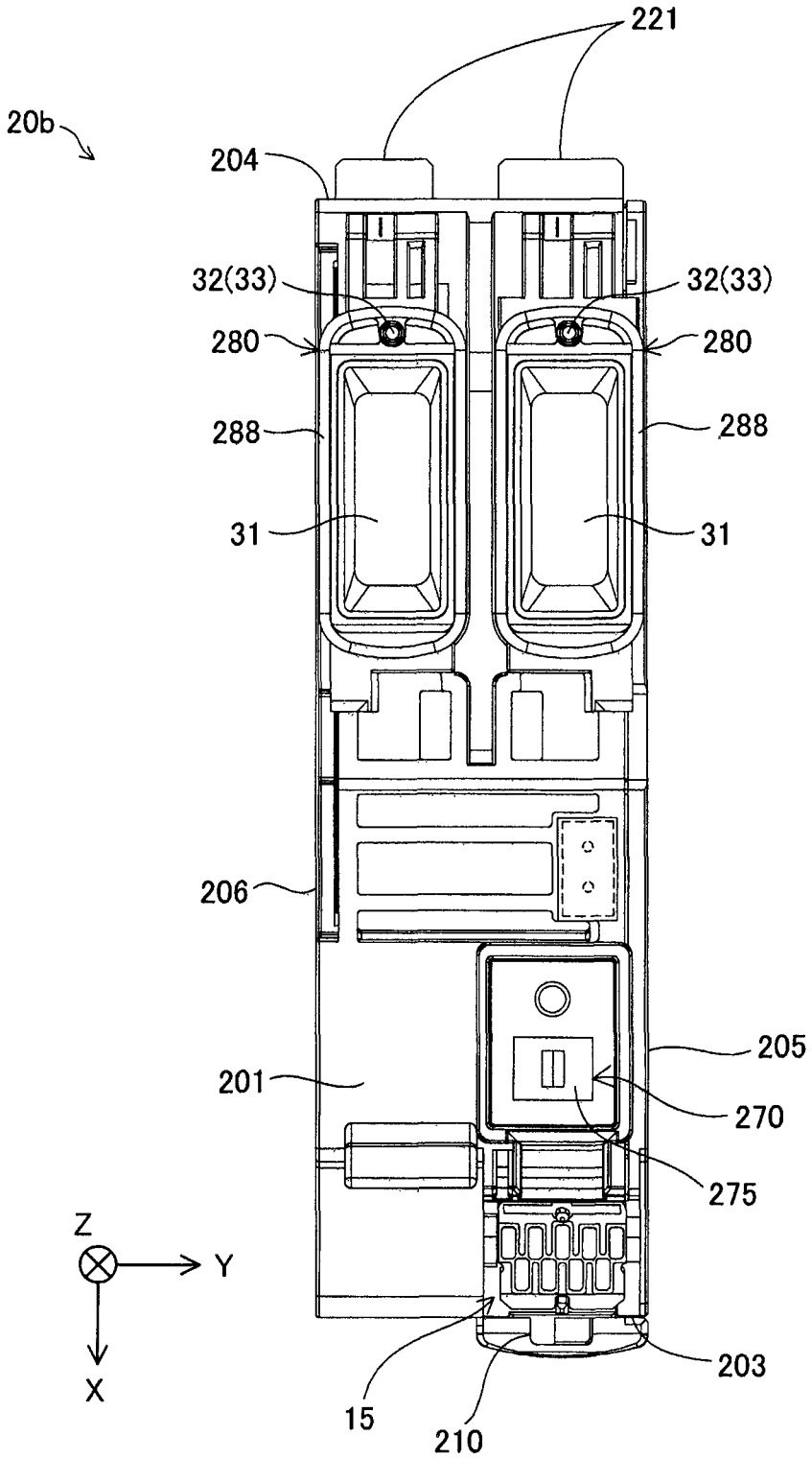
FIG. 27 is a bottom surface diagram of the cartridge illustrated in FIG. 26.

FIG. 26 is a perspective diagram illustrating a cartridge 20*b* according to a third embodiment. FIG. 27 is a bottom surface diagram of the cartridge 20*b* illustrated in FIG. 26. The same reference numerals as the cartridge 20 will be given with regard to the cartridge 20*b* illustrated in FIG. 26 and FIG. 27 if the elements of the cartridge 20*b* correspond to the elements of the cartridge 20 of the first embodiment. The width in the Y axial direction of the cartridge 20*b* illustrated in FIG. 26 and FIG. 27 is formed to be twice as much as the cartridge 20 of the above-described embodiment. The two printing material supply ports 280 are provided in the first surface 201 of the cartridge 20*b* along the width direction (Y axial direction). The two second cartridge side restricting sections 221 are provided in the fourth surface 204 of the cartridge 20*b* along the Y axial direction. The cartridge 20*b* is mounted to straddle two slots in the holder 60. The containing amount of ink in a printing material containing chamber 200*b* of the cartridge 20*b* is larger than the containing amount of ink in the printing material containing chamber 200 of the cartridge 20 according to the above-described embodiment. Except for the above-described respects, the cartridge 20*b* illustrated in FIG. 26 and FIG. 27 is similar to the cartridge 20 according to the first embodiment (FIG. 5). The number of the printing material supply ports 280 may be three or more along the width direction (Y axial direction). The number of the printing material containing chamber 200*b* of the cartridge 20*b* is one, and the printing material containing chamber 200*b* of the cartridge 20*b* is in communication with the plurality of printing material supply ports 280. In the cartridge 20*b*, the plurality of inner paths 33 are provided corresponding to the plurality of printing material supply ports 280. The plurality of inner paths 33 are in communication with the ventilation port 290 (FIG. 26).

For injecting ink into the cartridge 20*b*, the ink injection method described in the first embodiment and the second embodiment (FIG. 23, FIG. 25) can be used. However, in the cartridge 20*b* in which the plurality of printing material supply ports 280 and the plurality of inner paths 33 are provided, ink is injected into the printing material containing chamber 200*b* as follows.

In step S10, at least the inner path 33 provided in the printing material supply port 280 used for injecting ink in step S30 is closed. For example, in a case of injecting ink only from the printing material supply port 280 located on the +Y axial direction side (the +Y side printing material supply port 280) among the two printing material supply ports 280 illustrated in FIG. 27, it is sufficient for at least the inner path 33 of the +Y side printing material supply port 280 to be closed by the plug unit 722. Alternatively, irrespective of the printing material supply port 280 used for injecting ink, all the inner paths 33 may be closed. As a result of this, when injecting ink, it is possible to prevent ink, leaked from the printing material supply port 280 which is not used for injecting ink (the other side printing material supply port 280), from entering the inner path 33 provided in the other side printing material supply port 280.

In step S20, at least the opening end 288 of the printing material supply port 280 used for injecting ink in step S30 is sealed. Alternatively, irrespective of the printing material supply port 280 used for injecting ink, all the opening ends 288 may be sealed. In the case of sealing all the opening ends 288, the opening end 288 of the printing material supply port 280 which is not used for injecting ink may be sealed by the seal member 720 of the injection kit (injection device) 70 (FIG. 20), or may be sealed by a sheet member or the like which does not have a flow path used for injecting ink. As a result of this, when injecting ink, it is possible to prevent ink, leaked from the printing material supply port 280 which is not used for injecting ink (the other side printing material supply port 280), from leaking to the outside from the opening end 288 of the other side printing material supply port 280. Particularly, in a case of injecting pressurized ink into the printing material containing chamber 200*b* through the printing material supply port 280, there is a high possibility that ink will leak from the other side printing material supply port 280 to the outside. In this case, therefore, it is preferable to seal the opening end 288 of the other side printing material supply port 280.

In step S30, ink is injected into the printing material containing chamber 200*b* through at least one of the plurality of printing material supply ports 280. However, ink may be injected into the printing material containing chamber 200*b* through all the printing material supply ports 280 of the cartridge 20*b*. In the case of using all the printing material supply ports 280 for injecting ink, it may be possible to use a method (first method) in which ink is injected into the printing material containing chamber 200*b* through all the printing material supply ports 280 at the same time, or use a method (second method) in which one of the printing material supply ports 280 is selected by time division and ink is injected into the printing material containing chamber 200*b* through the selected printing material supply port 280. According to the second method, in the cartridge 20*b* in which the two printing material supply ports 280 are provided, ink is injected into the printing material containing chamber 200*b* through one of the two printing material supply ports 280 alternately one by one.

In step S40, air in the printing material containing chamber 200*b* is discharged to the outside by aspirating the inside of the printing material containing chamber 200*b* through at least one of the plurality of printing material supply ports 280. It is preferable to seal the printing material supply port 280, which is not used for discharging air, with a sealing member such as a sheet member, a rubber member, or the like, so as to prevent air distribution. Consequently, air can be efficiently discharged to the outside.

In the cartridge 20*b* of the third embodiment, the injection kit (injection device) 70, 70*a* described in the first embodiment and the second embodiment can be used. In such a case, it may be possible to prepare the injection kit (injection device) 70, 70*a* such that the number of the injection kit (injection device) 70, 70*a* corresponds to the number of the printing material supply ports 280.

D. Modified Example

Elements other than the elements described in the independent claims of the claims among the elements of the above-described embodiments are additional elements, and can be omitted as appropriate. Also, the present invention is not limited to the above-described embodiments, and various aspects are possible within a scope which does not depart from the gist of the present invention. For example, modifications described below are possible.

D-1. First Modified Example

Figure 28:
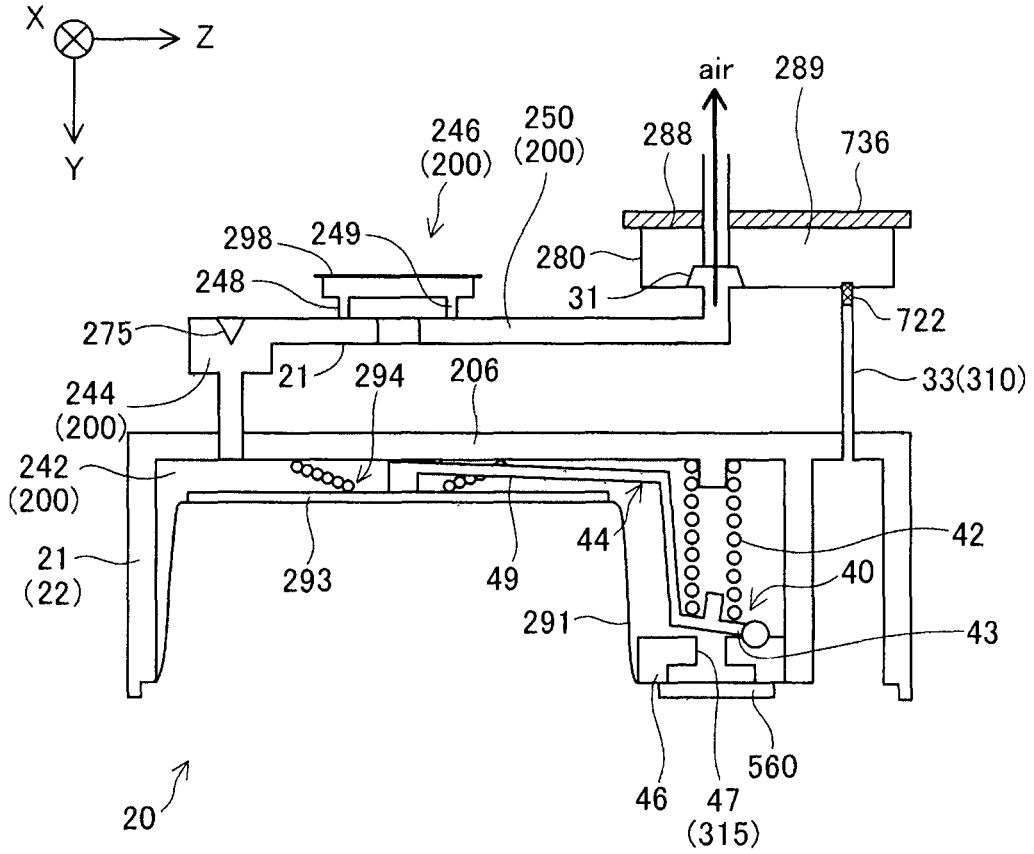
FIG. 28 is a diagram for explaining a step of depressurizing.

In the above-described first and third embodiments, a step of depressurizing the printing material containing chamber 200, 200*b* may be conducted before injecting ink into the printing material containing chamber 200, 200*b*. FIG. 28 is a diagram for explaining the step of depressurizing. Here, the step of depressurizing the printing material containing chamber 200 of the cartridge 20 will be explained. The step of depressurizing can be conducted using the injection kit (injection device) 70 of the first embodiment, for example. In the step of depressurizing, first, the lid member 23 is removed from the cartridge 20. Before conducting depressurization, the air introduction port 47 is closed by a sealing member 560, so that air will not enter the printing material containing chamber 200 from the air introduction port 47. Further, before conducting depressurization, the opening end 288 is sealed by the sealing unit 736 or the like. Furthermore, before conducting depressurization, the inner path 33 is closed by the plug unit 722. Then, by driving the discharging pump 718 (FIG. 20), air in the printing material containing chamber 200 is discharged to the outside, and depressurization is conducted. In depressurizing the printing material containing chamber 200*b* of the cartridge 20*b* according to the third embodiment, all the opening ends 288 are sealed and all the inner paths 33 are closed, so that depressurization through the printing material supply port 280 can be securely conducted.

D-2. Second Modified Example

The injection kit (injection device) 70 of the first embodiment may have a ventilation path for conducting gas-liquid exchange of the printing material containing chamber 200 when injecting ink into the printing material containing chamber 200. For example, a minute through hole is provided to penetrate the sealing unit 736. The through hole serves as the ventilation path. In a case of injecting ink into the printing material containing chamber 200 without depressurizing the printing material containing chamber 200, air existing in the printing material containing chamber 200 is discharged from the printing material exit 31 to the outside by the amount of the injected ink. Since the sealing unit 736 has the ventilation path, gas-liquid exchange of the printing material containing chamber 200 can be conducted efficiently when injecting ink.

D-3. Third Modified Example

In the above-described embodiments, it is sufficient for the state of the cartridge 20, 20*b* when conducting the ink injection method to be at least the receiving state in the step of discharging air, and it may be an optional state in the other steps.

D-4. Fourth Modified Example

The present invention is not limited to an ink jet printer or an ink cartridge thereof and it is possible to also apply the present invention to arbitrary liquid ejection devices which eject liquid other than ink and cartridges (liquid containing containers) used for the liquid ejection devices. For example, it is possible to apply the present invention to cartridges used for the following various types of liquid ejection devices. Further, the injection kit (injection device) 70, 70*a* or the ink injection method of the above embodiments can be applied to cartridges used for the following various types of liquid ejection.

- Image recording devices such as a facsimile device
- Colorant material ejection devices which are used in manufacturing color filters which are used in image display devices such as liquid crystal displays
- Electrode material ejection devices which are used in forming electrodes such as in organic EL (Electro Luminescent) displays and field emission displays (FED)
- Liquid ejection devices which eject a liquid which includes a bioorganic material which is used in manufacturing biochips
- Sample ejection devices as precision pipettes
- Lubricating oil ejection devices
- Resin liquid ejection devices
- Liquid ejection devices which eject lubricating oil in a pin-point manner in precision machinery such as clocks and cameras
- Liquid ejection devices which eject a transparent resin liquid such as an ultraviolet curing resin liquid onto a substrate in order to form a small semispherical lens (an optical lens) which is used in optical communication elements or the like
- Liquid ejection devices which eject an acid or alkali etching liquid in order to carry out etching of a substrate or the like
- Other arbitrary liquid ejection devices which are provided with a liquid ejection head which discharges liquid droplets in small amounts.

Here, "liquid droplet" refers to a state of liquid which is discharged from the liquid ejection device and includes liquid with particle shapes, liquid with teardrop shapes, and liquid which draws out a trail with a thread shape. In addition, it is sufficient if the "liquid" referred to here is a material which is able to be ejected from the liquid ejection device. For example, it is sufficient if the "liquid" is in a state where a substance is in a liquid phase, and materials in a liquid state such as materials with a liquid state where the viscosity is high or low and materials with a liquid state such as sols, gel water, other inorganic solvents, organic solvents, solutions, liquid resins, and liquid metals (metal fusion liquids) are included as "liquids". In addition, not only liquids as one state of a substance but where particles of a functional material which are formed as a solid material such as a pigment or metal particles are dissolved, dispersed, or mixed in a solvent are included as "liquids". In addition, ink as described in the embodiments described above, liquid crystals, or the like are given as representative examples of the liquid. Here, various types of liquid compositions such as typical water-based inks, oil-based inks, shell inks, and hot melt inks are included as ink.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An injection kit used for injecting a printing material into a cartridge configured to be mounted on a printer to supply the printing material to a head of the printer, the cartridge being provided with a container main body member, a lid member attached to the container main body member, a printing material containing chamber formed between the container main body member and the lid member, a printing material supply port formed on the container main body member and having a partition end section, a printing material exit provided inside the printing material supply port and configured to supply the printing material to the head from the printing material containing chamber, a communication path having communication port at an end portion, the communication port being provided inside the printing material supply port, and a ventilation port formed on the lid member and configured to introduce air from outside of the cartridge to inside of the cartridge, the ventilation port being formed in the other end portion of the communication path and communicating the communication port through the communication path, the injection kit comprising:

a plug unit configured and arranged to close the communication port; and an injection unit configured and arranged to inject the printing material into the printing material containing chamber through the printing material exit.

2. The injection kit according to claim 1, further comprising a sealing unit having a flow path communicating the outside and the inside of the printing material supply port when the injection kit is attached to the cartridge, and configured and arranged to seal the partition end section.

3. An injection kit used for injecting a printing material into a cartridge configured to be mounted on a printer to supply the printing material to a head of the printer, the cartridge being provided with a container main body member, a lid member attached to the container main body member, a printing material containing chamber formed between the container main body member and the lid member, a first printing material supply pew port formed on the container main body member and having a first partition end section, a second printing material supply port formed on the container main body member and having a second partition end section, a first printing material exit provided inside the first printing material supply port and configured to supply the printing material to the head from the printing material containing chamber, a second printing material exit provided inside the second printing material supply port and configured to supply the printing material to the head from the printing material containing chamber, a communication path having a first communication port at a first end portion and a second communication port at a second end portion, the first communication port being provided inside the first printing material supply port, the second communication port being provided inside the second printing material supply port, and a ventilation port formed on the lid member and configured to introduce air from outside of the cartridge to inside of the cartridge, the ventilation port being formed in a third end portion of the communication path and communicating the first and second communication ports through the communication path, the injection kit comprising:

a plug unit configured and arranged to close the first communication port; and an injection unit configured and arranged to inject the printing material into the printing material containing chamber through the first printing material exit.

4. The injection kit according to claim 3, further comprising a sealing unit configured and arranged to seal the first partition end section of the first printing material supply port when the injection kit is attached to the cartridge.

5. An injection kit used for injecting or discharging a fluid into or from a cartridge configured to be mounted on a printer to supply the printing material to a head of the printer, the cartridge being provided with a container main body member, a lid member attached to the container main body member, a printing material containing chamber formed between the container main body member and the lid member, a printing material supply port formed on the container main body member and having a partition end section, a printing material exit provided inside the printing material supply port and configured to supply the printing material to the head from the printing material containing chamber, a communication path having a communication port at an end portion, the communication port being provided inside the printing material supply port, and a ventilation port formed on the lid member and configured to introduce air from outside of the cartridge to inside of the cartridge, the ventilation port being formed in the other end portion of the communication path and communicating the communication port through the communication path, the injection kit comprising:

a sealing unit configured and arranged to seal the partition end section; and an instrument main body configured and arranged to penetrate the sealing unit, the instrument main body having a tip end section so that air in the printing material containing chamber is configured to be discharged from the tip end section.

6. The injection kit according to claim 5, wherein the sealing unit includes a plug member configured and arranged to close the communication port.

7. The injection kit according to claim 5, wherein the sealing unit includes a seal member and a containing member containing the seal member, the instrument main body being configured and arranged to penetrate the seal member and the containing member.

8. The injection kit according to claim 7, wherein the sealing unit includes a plug member configured and arranged to close the communication port.

* * * * *